US008485360B2

(12) United States Patent
Teys et al.

(10) Patent No.: US 8,485,360 B2
(45) Date of Patent: Jul. 16, 2013

(54) FRACTURABLE CONTAINER

(75) Inventors: Bradley Donald Teys, Shelly Beach (AU); David Stevens, Tewantin (AU)

(73) Assignee: Sands Innovations Pty, Ltd., Brisbane (AU)

( * ) Notice: Subject to any disclaimer, the term of this patent is extended or adjusted under 35 U.S.C. 154(b) by 108 days.

(21) Appl. No.: 13/041,131

(22) Filed: Mar. 4, 2011

(65) Prior Publication Data

US 2012/0223075 A1 Sep. 6, 2012

(51) Int. Cl.
*B65D 73/00* (2006.01)
*B65D 17/32* (2006.01)

(52) U.S. Cl.
USPC ..... 206/469; 206/470; 220/265; 220/266

(58) Field of Classification Search
USPC ..... 220/265, 266, 268, 645, 669; 206/469, 206/471
See application file for complete search history.

(56) References Cited

U.S. PATENT DOCUMENTS

| | | | | |
|---|---|---|---|---|
| 1,000,178 | A | 8/1911 | Kahl | |
| 1,372,325 | A | 3/1921 | Willemin | |
| 1,754,973 | A | 4/1930 | Walch | |
| 2,654,252 | A | 10/1953 | Davis | |
| 2,837,822 | A | 6/1958 | Wille | |
| 3,036,700 | A * | 5/1962 | Krug | 206/365 |
| 3,075,639 | A * | 1/1963 | Lingley | 206/366 |
| 3,116,152 | A | 12/1963 | Smith | |
| 3,133,679 | A | 5/1964 | Brown | |
| 3,154,418 | A | 10/1964 | Lovell | |
| D209,953 | S | 1/1968 | Stehl | |
| 3,410,457 | A | 11/1968 | Brown | |
| 3,421,654 | A | 1/1969 | Hexel | |
| 3,428,460 | A | 2/1969 | Ely | |
| D216,306 | S | 12/1969 | Dutch | |
| 3,521,805 | A | 7/1970 | Ward | |
| 3,581,885 | A * | 6/1971 | Wald | 206/470 |
| 3,618,751 | A | 11/1971 | Rich | |
| 3,620,676 | A | 11/1971 | Davis | |
| 3,635,376 | A | 1/1972 | Hellstrom | |
| 3,648,369 | A | 3/1972 | Frodsham | |
| 3,741,384 | A * | 6/1973 | Cloud | 206/461 |

(Continued)

FOREIGN PATENT DOCUMENTS

| | | |
|---|---|---|
| AU | 63787/98 | 11/1998 |
| AU | 1999 47456 | 2/2000 |

(Continued)

OTHER PUBLICATIONS

Engineers Edge website, Structural Beam Bending Equations/ Calculation Cantilever Beam with One Load Applied at End, http://www.engineersedge.com/beam_bending/beam_bending9.htm, accessed Nov. 15, 2010, 1 page.

(Continued)

*Primary Examiner* — Anthony Stashick
*Assistant Examiner* — Robert Stodola
(74) *Attorney, Agent, or Firm* — Fitch, Even, Tabin & Flannery

(57) ABSTRACT

A container fracturable along a break path having a generally constant wall thickness about the break path is disclosed. In order to provide a specific break path without reducing the structural integrity of the container, the body of the container is configured to concentrate stress along the break path.

20 Claims, 14 Drawing Sheets

U.S. PATENT DOCUMENTS

| | | | | | |
|---|---|---|---|---|---|
| 3,756,386 | A | | 9/1973 | Marckardt | |
| 3,835,995 | A | | 9/1974 | Haines | |
| 3,872,970 | A | | 3/1975 | Edison | |
| 3,891,331 | A | | 6/1975 | Avery | |
| 3,911,578 | A | | 10/1975 | Ushkow et al. | |
| 3,913,734 | A | | 10/1975 | Siegel | |
| 3,921,805 | A | | 11/1975 | Compere | |
| 3,946,652 | A | | 3/1976 | Gorin | |
| 3,948,394 | A | | 4/1976 | Hellstrom | |
| 3,986,640 | A | | 10/1976 | Redmond | |
| 4,005,776 | A | * | 2/1977 | Seeley | 206/306 |
| 4,011,949 | A | | 3/1977 | Braber et al. | |
| 4,106,621 | A | | 8/1978 | Sorenson | |
| 4,155,454 | A | | 5/1979 | Ryden | |
| 4,218,155 | A | | 8/1980 | Weidner | |
| 4,231,496 | A | | 11/1980 | Gilson | |
| 4,236,652 | A | | 12/1980 | Beguhn | |
| 4,266,667 | A | * | 5/1981 | Ishigaki | 206/469 |
| D259,533 | S | | 6/1981 | Frodsham | |
| 4,275,646 | A | | 6/1981 | Barna | |
| 4,277,194 | A | | 7/1981 | Smith | |
| D263,074 | S | | 2/1982 | Mason | |
| 4,317,284 | A | | 3/1982 | Prindle | |
| 4,331,255 | A | | 5/1982 | Fournier | |
| 4,338,338 | A | | 7/1982 | Popkes | |
| 4,341,302 | A | | 7/1982 | Baker et al. | |
| 4,387,809 | A | | 6/1983 | Botzler | |
| D275,517 | S | | 9/1984 | Hamilton et al. | |
| 4,493,574 | A | * | 1/1985 | Redmond et al. | 401/132 |
| 4,499,353 | A | * | 2/1985 | Shields | 206/470 |
| D281,719 | S | | 12/1985 | Holewinski et al. | |
| D281,813 | S | | 12/1985 | Holewinski et al. | |
| 4,580,587 | A | | 4/1986 | Rittich et al. | |
| 4,602,719 | A | | 7/1986 | Borst | |
| 4,611,715 | A | | 9/1986 | Redmond | |
| 4,615,120 | A | | 10/1986 | Newman | |
| 4,655,627 | A | | 4/1987 | Bradley | |
| 4,687,129 | A | * | 8/1987 | Cugley | 220/315 |
| 4,724,982 | A | * | 2/1988 | Redmond | 222/94 |
| 4,784,268 | A | * | 11/1988 | Perchak | 206/461 |
| 4,790,429 | A | | 12/1988 | Fukushima | |
| 4,830,222 | A | | 5/1989 | Read | |
| 4,841,637 | A | | 6/1989 | Scholzen | |
| 4,871,091 | A | | 10/1989 | Preziosi | |
| 4,888,188 | A | | 12/1989 | Castner, Sr. et al. | |
| 4,891,232 | A | | 1/1990 | Dahl | |
| 4,921,137 | A | | 5/1990 | Heijenga | |
| 4,922,611 | A | | 5/1990 | Levy | |
| 4,938,462 | A | * | 7/1990 | Gould | 206/470 |
| 5,009,894 | A | | 4/1991 | Hsaio | |
| 5,027,947 | A | | 7/1991 | Reighart | |
| 5,048,715 | A | | 9/1991 | Wolff | |
| 5,067,822 | A | | 11/1991 | Wirth et al. | |
| 5,105,603 | A | | 4/1992 | Natterer | |
| D327,013 | S | | 6/1992 | Reighart | |
| 5,119,560 | A | | 6/1992 | Noble | |
| 5,125,528 | A | | 6/1992 | Heyn et al. | |
| 5,125,534 | A | | 6/1992 | Rose et al. | |
| RE34,087 | E | | 10/1992 | Redmond | |
| D330,481 | S | | 10/1992 | Green | |
| 5,154,293 | A | | 10/1992 | Gould | |
| 5,154,318 | A | | 10/1992 | Lampard | |
| 5,158,192 | A | | 10/1992 | Lataix | |
| D334,058 | S | | 3/1993 | Noble | |
| 5,203,459 | A | | 4/1993 | Wade | |
| 5,209,354 | A | * | 5/1993 | Thornhill et al. | 206/469 |
| 5,215,221 | A | | 6/1993 | Dirksing | |
| 5,238,157 | A | | 8/1993 | Gentile | |
| 5,238,179 | A | | 8/1993 | Hart | |
| 5,240,415 | A | | 8/1993 | Haynie | |
| D340,408 | S | | 10/1993 | Hirsch | |
| 5,251,758 | A | | 10/1993 | Kolacek | |
| 5,277,103 | A | | 1/1994 | Cox | |
| D344,058 | S | | 2/1994 | Jones | |
| 5,305,928 | A | | 4/1994 | Verdaguer | |
| D347,277 | S | | 5/1994 | Snedden | |
| 5,308,008 | A | | 5/1994 | Ruegg | |
| 5,348,191 | A | | 9/1994 | Dekeyser | |
| 5,377,879 | A | | 1/1995 | Isaacs | |
| 5,392,945 | A | | 2/1995 | Syrek | |
| 5,395,031 | A | | 3/1995 | Redmond | |
| 5,398,908 | A | | 3/1995 | Kienle | |
| 5,408,804 | A | | 4/1995 | Schroder | |
| 5,409,125 | A | | 4/1995 | Kimber et al. | |
| D358,466 | S | | 5/1995 | Harris et al. | |
| 5,411,178 | A | | 5/1995 | Roders et al. | |
| 5,426,919 | A | | 6/1995 | Natterer et al. | |
| 5,431,357 | A | | 7/1995 | Ruegg | |
| 5,437,881 | A | | 8/1995 | Jeannin | |
| 5,440,976 | A | | 8/1995 | Giuliano et al. | |
| D362,304 | S | | 9/1995 | Wilson et al. | |
| 5,464,595 | A | | 11/1995 | Finnah | |
| 5,477,660 | A | | 12/1995 | Smith | |
| 5,491,895 | A | | 2/1996 | Lee | |
| 5,494,192 | A | | 2/1996 | Redmond | |
| 5,494,252 | A | | 2/1996 | Amit et al. | |
| 5,529,224 | A | | 6/1996 | Chan et al. | |
| D371,491 | S | | 7/1996 | Stein | |
| 5,553,805 | A | | 9/1996 | Ruegg | |
| D375,055 | S | | 10/1996 | Reed | |
| 5,564,569 | A | | 10/1996 | Kiefer | |
| D375,352 | S | | 11/1996 | Bologna | |
| D375,353 | S | | 11/1996 | Wolf | |
| 5,577,627 | A | | 11/1996 | Richie-Dubler | |
| 5,579,957 | A | | 12/1996 | Gentile et al. | |
| 5,582,330 | A | | 12/1996 | Iba | |
| RE35,437 | E | | 2/1997 | Ascone | |
| 5,676,244 | A | | 10/1997 | Green et al. | |
| 5,676,280 | A | | 10/1997 | Robinson | |
| 5,676,990 | A | | 10/1997 | Wawrzynski | |
| 5,695,084 | A | | 12/1997 | Chmela et al. | |
| 5,705,212 | A | | 1/1998 | Atkinson | |
| 5,706,980 | A | | 1/1998 | Dickerson | |
| 5,792,496 | A | | 8/1998 | Fekete et al. | |
| D398,843 | S | | 9/1998 | Wiegner | |
| 5,826,737 | A | | 10/1998 | Zakensberg | |
| 5,827,535 | A | | 10/1998 | Stone | |
| 5,839,609 | A | | 11/1998 | Zakensberg | |
| D402,546 | S | | 12/1998 | Massing | |
| D403,512 | S | | 1/1999 | Hennings | |
| 5,873,167 | A | | 2/1999 | Mason | |
| 5,873,483 | A | | 2/1999 | Gortz et al. | |
| 5,875,914 | A | | 3/1999 | Nguyen et al. | |
| D407,640 | S | | 4/1999 | Nelson et al. | |
| D408,217 | S | | 4/1999 | LoGiudice | |
| D408,278 | S | | 4/1999 | Konop | |
| 5,944,516 | A | | 8/1999 | Deshaies | |
| 5,975,305 | A | | 11/1999 | Barger | |
| 5,979,657 | A | | 11/1999 | Bumbera | |
| 6,003,673 | A | | 12/1999 | Vieu | |
| 6,003,710 | A | | 12/1999 | Huang | |
| 6,006,505 | A | | 12/1999 | Natterer | |
| 6,007,246 | A | | 12/1999 | Kinigakis et al. | |
| D419,063 | S | | 1/2000 | Baker et al. | |
| 6,024,219 | A | | 2/2000 | Froehlich et al. | |
| 6,041,930 | A | | 3/2000 | Cockburn | |
| D422,851 | S | | 4/2000 | Joergensen | |
| D425,617 | S | | 5/2000 | Snedden | |
| 6,062,413 | A | | 5/2000 | Redmond | |
| D426,708 | S | | 6/2000 | Francis | |
| 6,070,723 | A | | 6/2000 | Lewis | |
| 6,085,497 | A | | 7/2000 | Natterer | |
| 6,085,942 | A | | 7/2000 | Redmond | |
| 6,105,259 | A | | 8/2000 | Meyers et al. | |
| 6,112,898 | A | | 9/2000 | Siragusa et al. | |
| 6,116,450 | A | | 9/2000 | Huang | |
| 6,153,232 | A | | 11/2000 | Holten et al. | |
| D435,665 | S | | 12/2000 | Ogle | |
| 6,159,513 | A | | 12/2000 | Judlowe et al. | |
| D438,125 | S | | 2/2001 | Kaposi et al. | |
| D440,810 | S | | 4/2001 | Olson | |
| 6,209,748 | B1 | | 4/2001 | Dunbar | |
| 6,213,662 | B1 | | 4/2001 | Aljanedi | |
| 6,241,124 | B1 | | 6/2001 | Hoyt | |
| 6,245,367 | B1 | | 6/2001 | Galomb | |
| 6,254,907 | B1 | | 7/2001 | Galomb | |
| 6,279,233 | B1 | | 8/2001 | Cameron | |

D447,560 S 9/2001 Hellberg et al.
6,282,866 B1 9/2001 Natterer et al.
6,286,731 B1 9/2001 Lillelund et al.
6,287,612 B1 9/2001 Mandava et al.
6,295,735 B1 10/2001 Barger
6,299,012 B1 10/2001 Redmond
6,311,837 B1 11/2001 Blaustein et al.
6,328,928 B1 12/2001 Schroeder et al.
6,336,310 B1 1/2002 Redmond
6,341,472 B1 1/2002 Schroeder
6,347,727 B1 2/2002 Diaz
6,348,246 B1 2/2002 Finestone et al.
6,349,866 B1 2/2002 Stewart et al.
6,357,626 B1 3/2002 Zhang et al.
D456,507 S 4/2002 LeMarr et al.
6,364,113 B1 4/2002 Faasse, Jr. et al.
6,364,203 B2 4/2002 Toussant et al.
6,364,519 B1 4/2002 Hughes et al.
6,372,176 B1 4/2002 Ekendahl et al.
6,386,443 B1 5/2002 Szczerbinski
6,390,358 B1 5/2002 Stewart et al.
6,395,317 B1 5/2002 Singh et al.
D458,809 S 6/2002 Richardson et al.
6,412,653 B1 7/2002 Waterhouse
6,415,939 B1 7/2002 Redmond
D463,275 S 9/2002 Garcia
6,457,612 B1 10/2002 Zhang et al.
6,460,781 B1 10/2002 Garcia et al.
6,471,122 B1 10/2002 Stewart et al.
6,472,007 B2 10/2002 Bezek et al.
D467,336 S 12/2002 Gilbard et al.
D467,499 S 12/2002 Garza et al.
6,516,939 B1 2/2003 Schmidt et al.
D471,628 S 3/2003 Louviere
6,536,974 B2 3/2003 Redmond
6,550,224 B2 4/2003 Kleinschmidt
6,558,150 B1 5/2003 Karbach
6,589,041 B2 7/2003 Feil
6,589,042 B2 7/2003 Stammler et al.
6,596,328 B1 7/2003 Bezek et al.
D477,965 S 8/2003 Kortleven et al.
D479,674 S 9/2003 Freed
D480,318 S 10/2003 Settele
D482,578 S 11/2003 Kortleven et al.
6,649,114 B2 11/2003 Lochner et al.
6,651,848 B1 11/2003 Redmond
D482,939 S 12/2003 Lillelund et al.
D483,257 S 12/2003 Lim
D484,425 S 12/2003 Settele
6,655,903 B2 12/2003 Kohler
6,662,454 B2 12/2003 Harrold
6,663,019 B2 12/2003 Garcia et al.
6,673,301 B2 1/2004 Cargile et al.
6,675,482 B1 1/2004 Gilbert, Jr. et al.
6,685,058 B2 2/2004 Redmond
6,688,469 B1 2/2004 Barnes
6,691,901 B2 2/2004 Parve et al.
6,692,212 B2 2/2004 Trautwein et al.
D487,397 S 3/2004 Peghini
6,698,165 B1 3/2004 Natterer
6,699,006 B2 3/2004 Schlimgen et al.
6,701,692 B1 3/2004 Niehr
6,706,297 B1 3/2004 Toth et al.
6,712,599 B2 3/2004 Schlimgen et al.
D488,079 S 4/2004 Mastroianni
D488,394 S 4/2004 Overthun et al.
6,726,054 B2 4/2004 Fagen et al.
D489,820 S 5/2004 Masuda et al.
6,736,379 B1 5/2004 Wegner et al.
D492,407 S 6/2004 Masuda et al.
D494,676 S 8/2004 Dubniczki et al.
D494,877 S 8/2004 Kempe et al.
6,769,558 B1 8/2004 Bucholtz
6,769,684 B2 8/2004 Gandelheidt
6,783,030 B2 8/2004 Redmond
6,802,423 B2 10/2004 O'Brien
D500,850 S 1/2005 Clark et al.
6,845,597 B2 1/2005 Redmond
6,848,339 B2 2/2005 Hakim
6,851,920 B2 2/2005 Trautwein et al.
6,860,405 B1 3/2005 Poynter
6,874,665 B2 4/2005 Doherty et al.
6,905,323 B2 6/2005 Keller
6,910,623 B2 6/2005 Stewart et al.
6,928,870 B1 8/2005 Liebowitz
6,942,097 B1 9/2005 Stremple et al.
6,953,420 B2 10/2005 Karbach
6,957,909 B1 10/2005 Dingeldein et al.
D514,935 S * 2/2006 Sturk ..... D9/449
7,004,322 B1 2/2006 Bartoli
7,005,109 B2 2/2006 Husar
D517,207 S 3/2006 Poynter
7,013,568 B2 3/2006 Schmidt
D524,610 S 7/2006 Kushner
7,069,705 B2 7/2006 Redmond
7,104,419 B2 9/2006 Fagen et al.
7,121,409 B1 10/2006 Hamilton et al.
D531,918 S 11/2006 Heiligenstein et al.
7,140,863 B2 11/2006 Koppenhofer
7,143,910 B2 12/2006 Redmond
D534,610 S 1/2007 Weinstein
D534,648 S 1/2007 Zahn et al.
7,175,215 B2 2/2007 Harris
D539,420 S 3/2007 Zahn et al.
7,198,161 B2 4/2007 Bucholtz
7,210,600 B1 5/2007 Delio, Jr.
7,219,816 B1 5/2007 Xia et al.
7,226,230 B2 6/2007 Liberatore
D545,636 S 7/2007 Risden
D545,640 S 7/2007 Risden
D547,134 S 7/2007 Everett et al.
D547,860 S 7/2007 Zahn et al.
7,240,797 B1 7/2007 Grossman
D548,834 S 8/2007 Hansen
7,258,255 B2 8/2007 Vogel et al.
D551,760 S 9/2007 Zahn et al.
7,270,239 B1 9/2007 Ross
D556,321 S 11/2007 Starnes
7,290,380 B2 11/2007 Natterer
7,293,683 B2 11/2007 Natterer
7,299,947 B2 11/2007 Lingenhoff
D560,442 S 1/2008 Teys et al.
D560,443 S 1/2008 Teys et al.
7,314,196 B2 1/2008 Gandelheidt et al.
7,314,328 B2 1/2008 Liberatore
7,320,398 B2 1/2008 Bertl et al.
7,325,370 B2 2/2008 Redmond
7,325,703 B2 2/2008 Gherdan et al.
7,325,994 B2 2/2008 Liberatore
D565,193 S 3/2008 Price
7,347,680 B2 3/2008 Hessenbruch
D567,004 S 4/2008 Bottega
7,361,008 B2 4/2008 Crepaz
7,370,564 B2 5/2008 Hennes
7,374,046 B1 5/2008 O'Brien
D570,164 S 6/2008 Teys et al.
D571,002 S 6/2008 Starnes
D572,089 S 7/2008 Teys et al.
D572,976 S 7/2008 Mansfield
7,413,080 B2 * 8/2008 Van House ..... 206/470
7,413,083 B2 8/2008 Belfance et al.
7,431,529 B1 10/2008 Rushe et al.
D580,715 S 11/2008 Finell
7,478,960 B2 1/2009 Glover
7,487,625 B2 2/2009 Natterer et al.
7,487,894 B2 2/2009 Zahn et al.
7,490,974 B2 2/2009 Hennes
7,503,604 B2 3/2009 Raeder et al.
7,506,762 B2 3/2009 Nelson et al.
7,513,397 B2 4/2009 Zahn et al.
D592,826 S 5/2009 Lingenhoff
7,540,291 B2 6/2009 Gandelheidt
7,556,147 B2 7/2009 Leiner et al.
7,562,796 B2 7/2009 Zahn et al.
7,568,590 B1 8/2009 Gross et al.
7,571,813 B2 * 8/2009 Weisskopf ..... 206/755
7,600,358 B2 10/2009 Natterer
D604,635 S 11/2009 Xu

| | | | | |
|---|---|---|---|---|
| 7,628,125 | B2 | 12/2009 | Kaita et al. | |
| 7,631,776 | B2 | 12/2009 | Vovan et al. | |
| 7,637,417 | B2 | 12/2009 | Fite, IV et al. | |
| 7,648,328 | B2 | 1/2010 | Binder et al. | |
| D609,362 | S | 2/2010 | Rannikko et al. | |
| 7,669,597 | B2 | 3/2010 | Sullivan et al. | |
| 7,669,714 | B1 | 3/2010 | Grossman | |
| 7,690,883 | B2 | 4/2010 | Huber et al. | |
| 7,703,619 | B2 | 4/2010 | Van Puijenbroek | |
| D636,890 | S | 4/2011 | Teys et al. | |
| 7,922,021 | B2 * | 4/2011 | Golden | 220/4.22 |
| 7,993,692 | B2 | 8/2011 | Finley et al. | |
| 8,028,837 | B2 | 10/2011 | Gerstle et al. | |
| 8,091,242 | B2 | 1/2012 | Teys et al. | |
| 8,151,984 | B2 | 4/2012 | Braeder et al. | |
| 8,403,936 | B2 | 3/2013 | Hess et al. | |
| 2001/0001470 | A1 | 5/2001 | Toussant et al. | |
| 2002/0104856 | A1 | 8/2002 | Clark et al. | |
| 2002/0113074 | A1 * | 8/2002 | Baker | 220/835 |
| 2002/0180114 | A1 | 12/2002 | Cargile et al. | |
| 2003/0015605 | A1 | 1/2003 | Garcia et al. | |
| 2003/0029868 | A1 | 2/2003 | Davidov et al. | |
| 2003/0066870 | A1 | 4/2003 | Stewart | |
| 2003/0183641 | A1 | 10/2003 | Asbury | |
| 2003/0222099 | A1 | 12/2003 | Keller | |
| 2004/0006874 | A1 | 1/2004 | Kamm et al. | |
| 2004/0074802 | A1 | 4/2004 | Piliero et al. | |
| 2004/0094548 | A1 | 5/2004 | Laveault | |
| 2004/0105715 | A1 | 6/2004 | Spelman et al. | |
| 2004/0187662 | A1 | 9/2004 | Ulmer | |
| 2005/0025561 | A1 | 2/2005 | Larsen | |
| 2005/0042019 | A1 | 2/2005 | Gaynes et al. | |
| 2005/0116482 | A1 | 6/2005 | Harris | |
| 2005/0218106 | A1 | 10/2005 | Yui | |
| 2005/0236442 | A1 | 10/2005 | Kratzer | |
| 2005/0249031 | A1 | 11/2005 | Morgese et al. | |
| 2005/0252351 | A1 | 11/2005 | Natterer | |
| 2006/0124654 | A1 | 6/2006 | Cai | |
| 2006/0191805 | A1 | 8/2006 | Vogel et al. | |
| 2006/0283727 | A1 | 12/2006 | Nelson et al. | |
| 2007/0012710 | A1 | 1/2007 | Vovan | |
| 2007/0045317 | A1 | 3/2007 | Rosender et al. | |
| 2007/0102308 | A1 | 5/2007 | Tremblay et al. | |
| 2007/0125667 | A1 | 6/2007 | Lee et al. | |
| 2007/0187277 | A1 | 8/2007 | Furlong | |
| 2007/0235104 | A1 | 10/2007 | Lingenhoff | |
| 2007/0267183 | A1 | 11/2007 | Hennes | |
| 2008/0002921 | A1 | 1/2008 | Redmond | |
| 2008/0034710 | A1 | 2/2008 | Ehrmann | |
| 2008/0040862 | A1 | 2/2008 | Bravo | |
| 2008/0072432 | A1 | 3/2008 | Teys et al. | |
| 2008/0072433 | A1 | 3/2008 | Ohring et al. | |
| 2008/0149523 | A1 | 6/2008 | O'Brien | |
| 2008/0152767 | A1 | 6/2008 | Maisel | |
| 2008/0191381 | A1 | 8/2008 | Hennes | |
| 2008/0210716 | A1 | 9/2008 | Weyts | |
| 2008/0278340 | A1 | 11/2008 | Jokele et al. | |
| 2009/0000255 | A1 | 1/2009 | Dandl et al. | |
| 2009/0025340 | A1 | 1/2009 | Natterer et al. | |
| 2009/0050649 | A1 | 2/2009 | Rushe et al. | |
| 2009/0057386 | A1 | 3/2009 | Redmond | |
| 2009/0071099 | A1 | 3/2009 | Ehrmann et al. | |
| 2009/0071100 | A1 | 3/2009 | Ehrmann et al. | |
| 2009/0071107 | A1 | 3/2009 | Ehrmann | |
| 2009/0097949 | A1 | 4/2009 | Binder et al. | |
| 2009/0152261 | A1 | 6/2009 | Capriotti | |
| 2009/0173039 | A1 | 7/2009 | Slomski et al. | |
| 2009/0173041 | A1 | 7/2009 | Moessnang | |
| 2009/0173049 | A1 | 7/2009 | Ruzic et al. | |
| 2009/0217532 | A1 | 9/2009 | Cantu | |
| 2009/0217625 | A1 | 9/2009 | Moessnang | |
| 2009/0218374 | A1 | 9/2009 | Liberatore | |
| 2009/0241469 | A1 | 10/2009 | Moessnang et al. | |
| 2009/0255218 | A1 | 10/2009 | Moessnang | |
| 2009/0260319 | A1 | 10/2009 | Botzenhardt et al. | |
| 2009/0260320 | A1 | 10/2009 | Miller et al. | |
| 2009/0260325 | A1 | 10/2009 | Haering | |
| 2009/0260326 | A1 | 10/2009 | Grimm et al. | |
| 2009/0261230 | A1 | 10/2009 | Imhof | |
| 2009/0266028 | A1 | 10/2009 | Zeller et al. | |
| 2009/0288365 | A1 | 11/2009 | Negele | |
| 2009/0294454 | A1 | 12/2009 | Harding | |
| 2009/0314415 | A1 | 12/2009 | Gross et al. | |
| 2009/0314777 | A1 | 12/2009 | Gross et al. | |
| 2010/0024360 | A1 | 2/2010 | Ehrmann et al. | |
| 2010/0024668 | A1 | 2/2010 | Huber et al. | |
| 2010/0065567 | A1 | 3/2010 | Vovan | |
| 2010/0065582 | A1 | 3/2010 | Nelson et al. | |
| 2010/0095640 | A1 | 4/2010 | Grimm | |
| 2010/0107572 | A1 | 5/2010 | Slomp et al. | |
| 2010/0108680 | A1 | 5/2010 | Vovan et al. | |
| 2010/0116772 | A1 | 5/2010 | Teys | |
| 2011/0024462 | A1 | 2/2011 | Teys | |
| 2011/0100859 | A1 * | 5/2011 | Burattini | 206/524.6 |
| 2011/0290800 | A1 | 12/2011 | Teys | |

FOREIGN PATENT DOCUMENTS

| | | | | |
|---|---|---|---|---|
| AU | 750188 | | | 5/2001 |
| AU | 764881 | | | 9/2003 |
| AU | 2004 100000 | | | 2/2004 |
| AU | 200415919 | | | 6/2005 |
| AU | 200415920 | | | 6/2005 |
| BE | 1008054 | | | 1/1996 |
| CA | 2376147 | | | 4/2001 |
| CN | 2081671 | U | | 7/1991 |
| DE | 2124931 | | | 11/1972 |
| DE | 2232861 | A | * | 1/1974 |
| DE | 7523870 | | | 11/1976 |
| DE | 19627243 | | | 1/1998 |
| DE | 19904649 | | | 10/2000 |
| DE | 7237741 | | | 10/2002 |
| DE | 202004006760 | | | 9/2005 |
| DE | 102004055796 | | | 5/2006 |
| DE | 102005028618 | | | 12/2006 |
| DE | 102007009457 | | | 8/2008 |
| EP | 496587 | | | 7/1992 |
| EP | 0778018 | | | 6/1997 |
| EP | 778018 | | | 11/1997 |
| EP | 937655 | | | 8/1998 |
| EP | 1068850 | | | 10/2000 |
| EP | 1121922 | | | 8/2001 |
| FR | 1418834 | | | 11/1965 |
| FR | 2063745 | | | 9/1971 |
| FR | 2169652 | A | * | 9/1973 |
| FR | 2622424 | | | 5/1989 |
| FR | 2680456 | | | 2/1993 |
| FR | 2697331 | | | 4/1994 |
| GB | 890770 | | | 3/1962 |
| GB | 1017425 | | | 1/1966 |
| GB | 2343440 | | | 5/2000 |
| GB | 2351272 | | | 12/2000 |
| GB | 2373710 | | | 10/2002 |
| GB | 2375040 | | | 11/2002 |
| GB | 2382020 | | | 5/2003 |
| GB | 2383989 | | | 7/2003 |
| GB | 2401025 | | | 11/2004 |
| GB | 2418193 | | | 3/2006 |
| GB | 2454230 | | | 5/2009 |
| JP | 6278655 | | | 5/1987 |
| JP | 01-084846 | A | | 3/1989 |
| JP | 1104271 | | | 7/1989 |
| JP | 04082701 | | | 3/1992 |
| JP | 4122213 | | | 4/1992 |
| JP | 7255581 | | | 10/1995 |
| JP | 9252911 | | | 9/1997 |
| JP | 2000005024 | | | 1/2000 |
| JP | 2000333811 | | | 12/2000 |
| JP | 2001299552 | | | 10/2001 |
| JP | 2005152558 | | | 6/2005 |
| KR | 100740376 | B1 | | 7/2007 |
| NL | 1036045 | | | 10/2009 |
| SI | 9400348 | | | 4/1996 |
| SI | 9600327 | | | 6/1998 |
| WO | 9630272 | | | 10/1996 |
| WO | 9703634 | | | 2/1997 |
| WO | 9706073 | | | 2/1997 |
| WO | 9713428 | | | 4/1997 |
| WO | 9734816 | | | 9/1997 |

| | | |
|---|---|---|
| WO | 9808751 | 3/1998 |
| WO | 9819583 | 5/1998 |
| WO | 9851259 | 11/1998 |
| WO | 9903441 | 1/1999 |
| WO | 9909871 | 3/1999 |
| WO | 9944482 | 9/1999 |
| WO | 9961337 | 12/1999 |
| WO | 0100134 | 1/2001 |
| WO | 0136293 | 5/2001 |
| WO | 0170080 | 9/2001 |
| WO | 0232782 | 4/2002 |
| WO | 03055435 | 7/2003 |
| WO | 03086900 | 10/2003 |
| WO | 2004063048 | 7/2004 |
| WO | 2005065498 | 7/2005 |
| WO | 2005116590 | 12/2005 |
| WO | 2006000376 | 1/2006 |
| WO | 2006051305 | 5/2006 |
| WO | 2006137674 | 12/2006 |
| WO | 2007082034 | 7/2007 |
| WO | 2007087357 | 8/2007 |
| WO | 2008092200 | 7/2008 |
| WO | 2009006690 | 1/2009 |
| WO | 2009047821 | 4/2009 |
| WO | 2010/065980 | 6/2010 |

OTHER PUBLICATIONS

Wikipedia website, Euler-Bernoulli Beam Equation, http://en.wikipedia.org/wiki/Euler-Bernoulli_beam_equation, accessed Nov. 15, 2011, 14 pages.

U.S. Appl. No. 12/795,220, filed Jun. 7, 2010, entitled Reclosable Container, 45 pages.

U.S. Appl. No. 13/133,641, filed Jun. 8, 2011, entitled Dispensing Container , 65 pages.

"International Search Report and Written Opinion dated Oct. 9, 2012, from related International (PCT) Patent Application No. PCT/IB2012/000205, six pages."

Japanese Patent Office, Notice of Reason of Rejection for Application No. 2007-548642, Mailed Mar. 9, 2010, which contains a concise statement of relevance of Japanese references 62-78655 and 1-104271, 2 pages.

* cited by examiner

FRACTURABLE CONTAINER

FIELD OF THE INVENTION

The present invention relates generally to a container and, more particularly, to a fracturable container for opening.

BACKGROUND

Containers are made from various materials, including glass, metal and plastic. Recently, plastic containers have been favored for their light weight construction and low cost. In particular, plastic containers can be made by known molding and thermoforming processes. In order to withstand shipping, handling and storage, the plastic should be robust. Preferred plastics today include PET and high-impact polystyrene. In particular, the plastics are selected so as to resist fracturing upon the application of expected and unexpected forces.

Many of the known sealed containers include a body defining a cavity for receiving material and a lid or cover for sealing the cavity. In some containers, the cover is connected to the body by a mechanical interconnection, such as a snap-fit connection or threaded connection. In other containers, the cover can be connected to the body by adhesives and heat sealing. In some of these containers, the cover can be easily removed from the body to allow for access to the stored material. With small containers, however, removal of the cover can be difficult.

Other containers can be configured so that cover remains connected to the body, and the body can be fractured upon the application of force. To provide a fracturable opening while maintaining the general strength of a container made from PET or high-impact polystyrene, one of the walls of the container will have a weakened section, such as a thinned wall section or perforations of the wall.

Plastic containers, including a weakened section, are often made by a basic molding process, as the wall thickness can be varied during the molding process. Other plastic containers with a weakened section are thermoformed, where the weakened section is a result of cutting or perforating. Due to the reduced wall thickness associated with thermoformed containers, the weakened section is produced on generally flat sections of the containers so that a minimum wall thickness can be maintained, thereby providing a measure of structural stability, while weakening a section sufficiently to be fracturable.

The weakened section allows the package to maintain a desired structural integrity inherent in the PET or high-impact polystyrene along the majority of the container body. However, by weakening a section of the container body, the container can be undesirably compromised by the application of force on the container body or as a result of internal pressure within the container, resulting in an unsealed container.

To reduce the impact of employing a weakened section, known thermoformed containers position the weakened section to extend along a corner or otherwise smaller section of the container. The resulting small opening from this minimized weakened section does not provide for free flow of product stored in the cavity under the influence of gravity. While this aids in reducing unintended dispensation from the cavity, a user must squeeze or otherwise deform the container rather than simply tilting the container to dispense the contents.

Many containers include an inner coating or layer to provide further protection for the contents. Although these coatings are effective for particular materials to be stored in the container or for particular environments, they are not intended to accommodate for the compromised integrity of the container body resulting from the weakened wall section.

DETAILED DESCRIPTION

Figure 1:
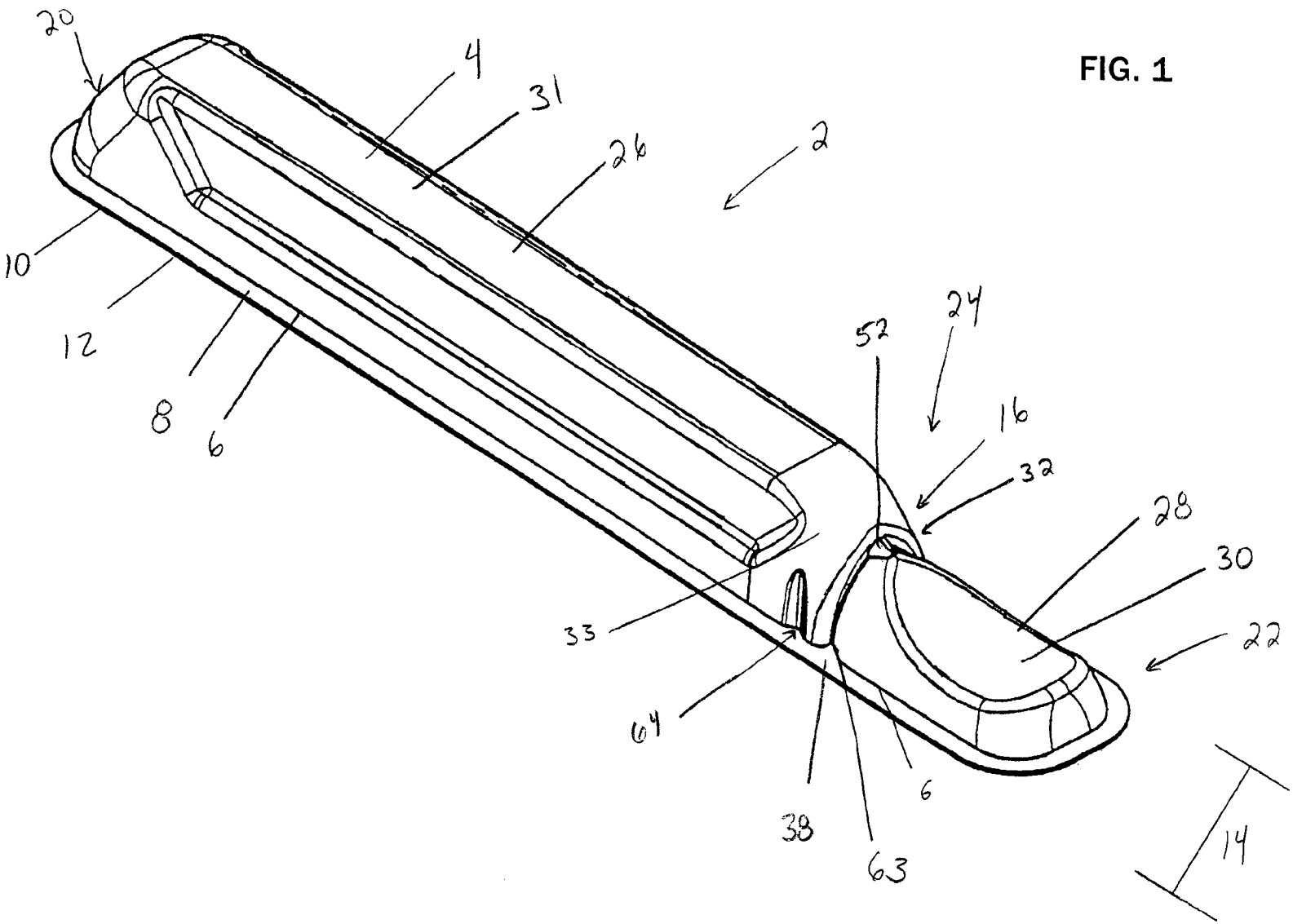
FIG. 1 is a perspective view of a container.

In FIG. 1, a container 2 is shown for sealing dispensable goods in a cavity. The container 2 includes a body 4 defining the cavity for receiving the dispensable goods. An upper edge 6 of the body 4 defines an opening of the cavity. A flange 8 of the container 2 extends from the upper edge 6 of the body 4. An upper surface 10 of the flange 8 has a generally flat surface for having a cover 12 affixed thereto. The body 4 and cover 12 provide a sealed environment for storage of the dispensable goods. In order to easily access the goods, the container 2 is fracturable across its width 14 along a specified break path 16. To ensure the integrity of the sealed environment within the container, the body 4 has a generally constant wall thickness 18, even along the break path 16.

Figure 2:
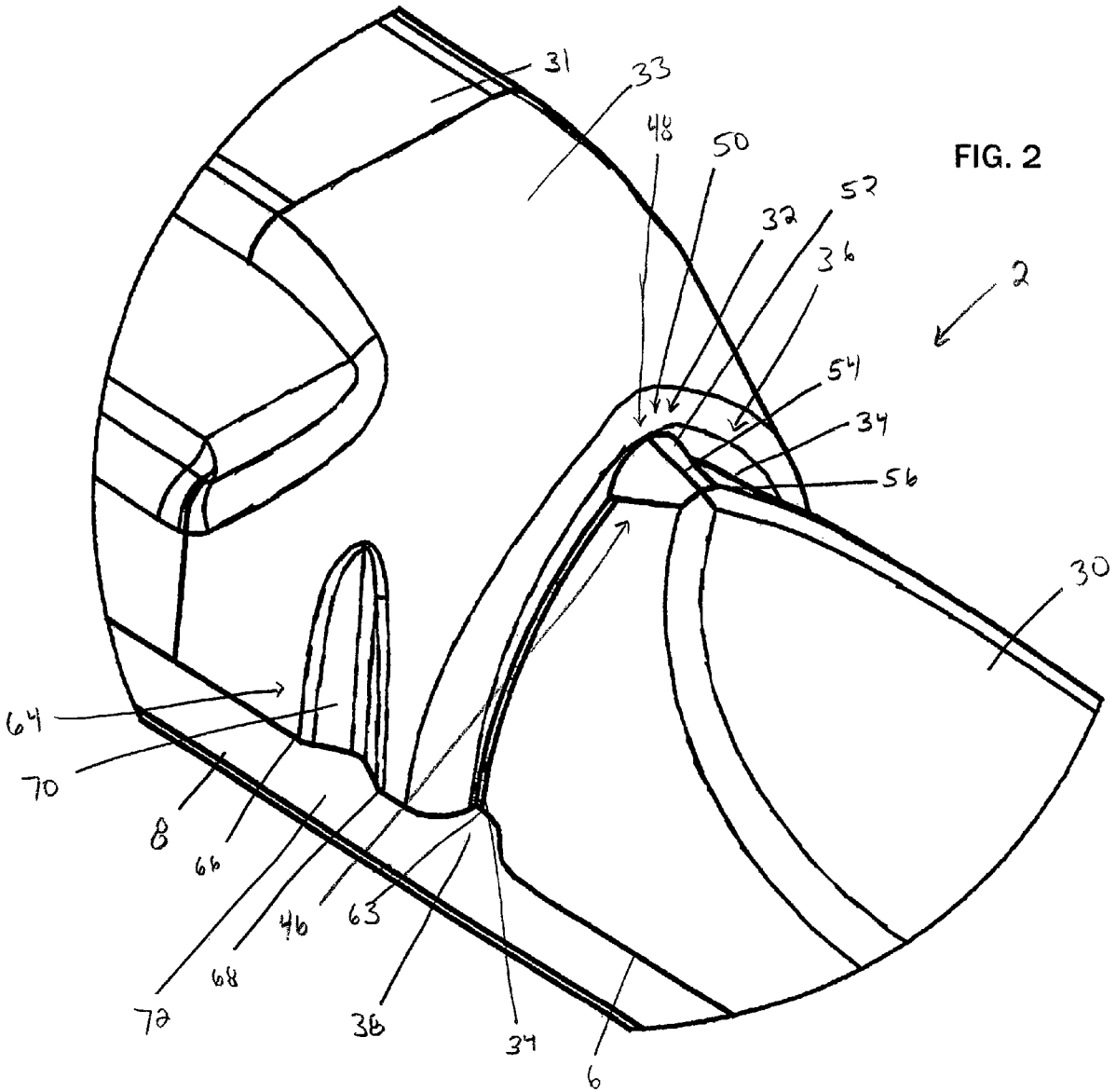
FIG. 2 is an enlarged perspective view of an intermediate portion of the container of FIG. 1.
Figure 3:
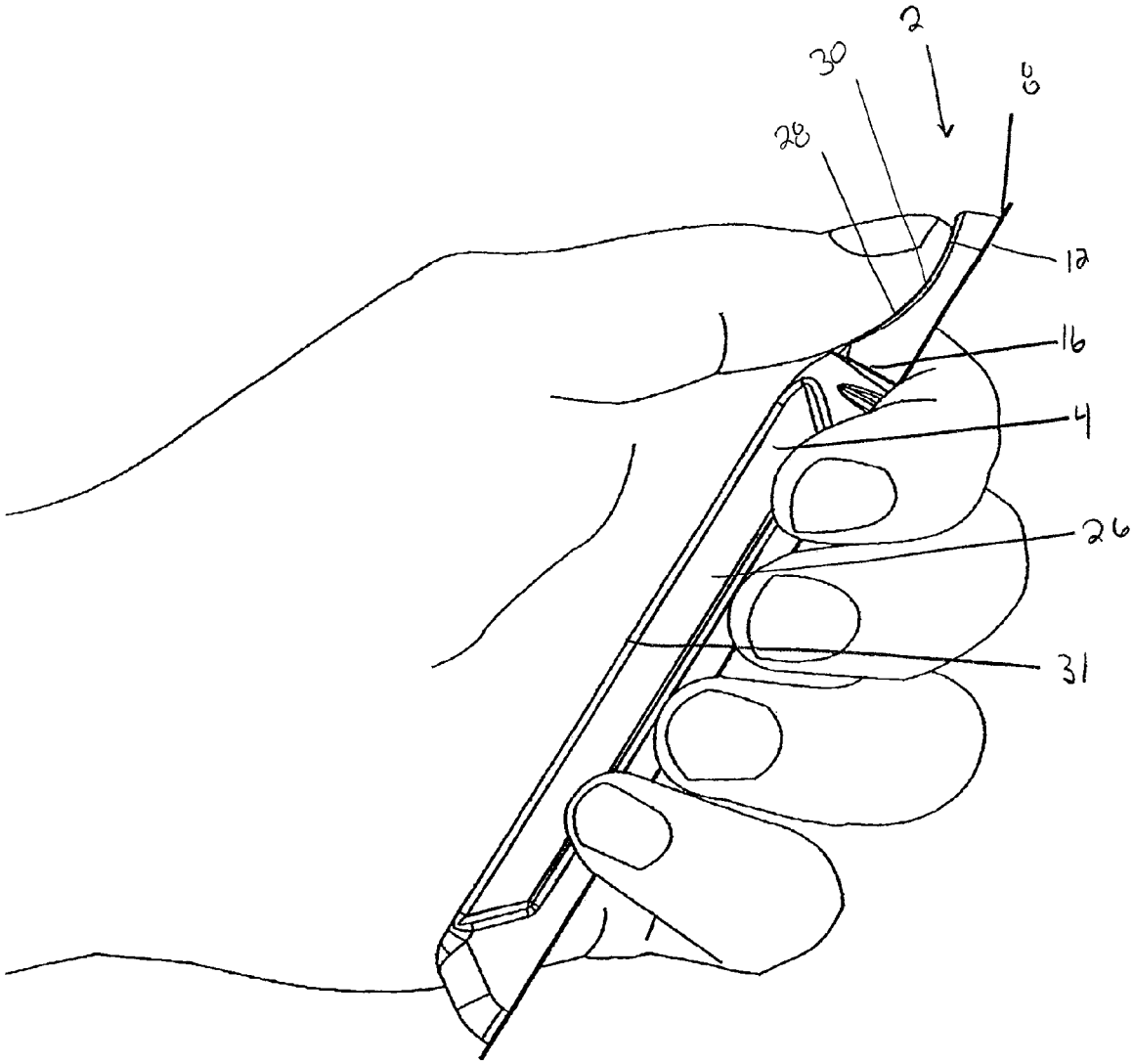
FIG. 3 is a perspective view of the container of FIG. 1 being grasped by a user.

As shown in FIGS. 1-3, the body 4 includes an elongate construction, although other configurations are contemplated. The body 4 includes opposite ends 20 and 22 with an intermediate portion 24 positioned between the opposite ends 20 and 22. As shown in FIGS. 1-9, the break path 16 is positioned within the intermediate portion 24 of the body 4. As shown in FIG. 3, the body 4 includes a handle portion 26 extending from the first end 20 to the break path 16, and a distal portion 28 extending from the second end 22 to the break path 16. The handle portion 26 is configured to be gripped by a user to allow for one-handed operation and use of the container 2. An engageable surface 30 of the distal portion 28 is configured to be engaged by a user, such as by a thumb of the user, to exert an opening force on the distal portion 28 of the body 4 so that the body 4 fractures along the break path 16. As shown in FIG. 3, the engageable surface 30 is offset from a lower surface 31 of the handle portion 26 and arcuate, such as to approximate a finger, to provide an ergonomic engagement.

As shown in FIGS. 10A-16B, the generally constant wall thickness 18 about the break path 16 reduces the tendency for the integrity of the container 2 to be unintentionally compromised during filling, handling and storage. In order to provide increased structural integrity, the container 2 is configured to maximize the stress at a base surface 32 along the break path 16 of the container 2 as force is being exerted on the engageable surface 30 of the distal portion 28 of the body 4.

In particular, as shown in FIGS. 1, 2, and 4-9, the body 4 includes a bend 34 extending across the width 14 of the body 4 and which defines the break path 16. In addition, as shown in FIGS. 1 and 2, the container 2 includes a tapered profile 36 within the intermediate portion 24 of the body 4 and an enlarged flange portion 38 of the flange 8 adjoining the break path 16.

The bend 34 of the body 4 is provided by the thermoforming process. A similar bend could be provided by bending a preformed body to provide a crease. Bending, however, may not be preferred because it may produce stress along the bend, which may reduce the overall strength of the body 4 and may lead to undesired fracturing. In contrast, the thermoformed bend 34 does not result in additional stress to the body 4.

Figure 7:
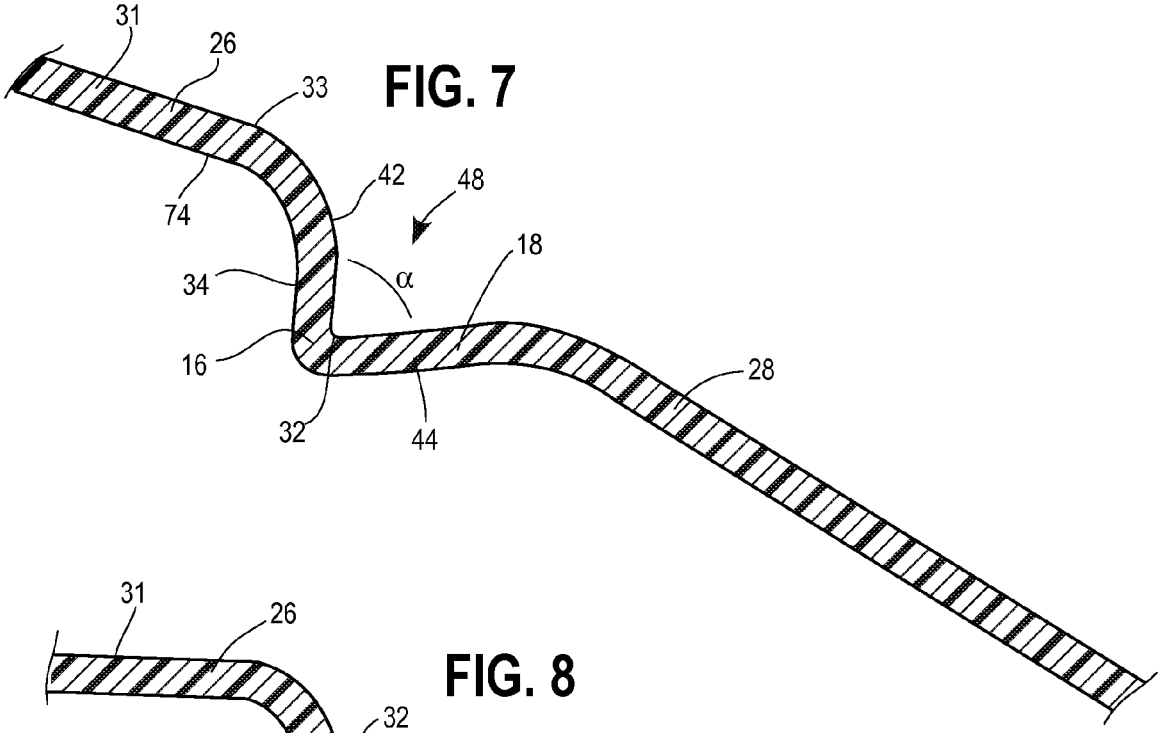
FIG. 7 is an enlarged cross-sectional view of the side elevational view of an intermediate portion of the container of FIG. 1.
Figure 8:
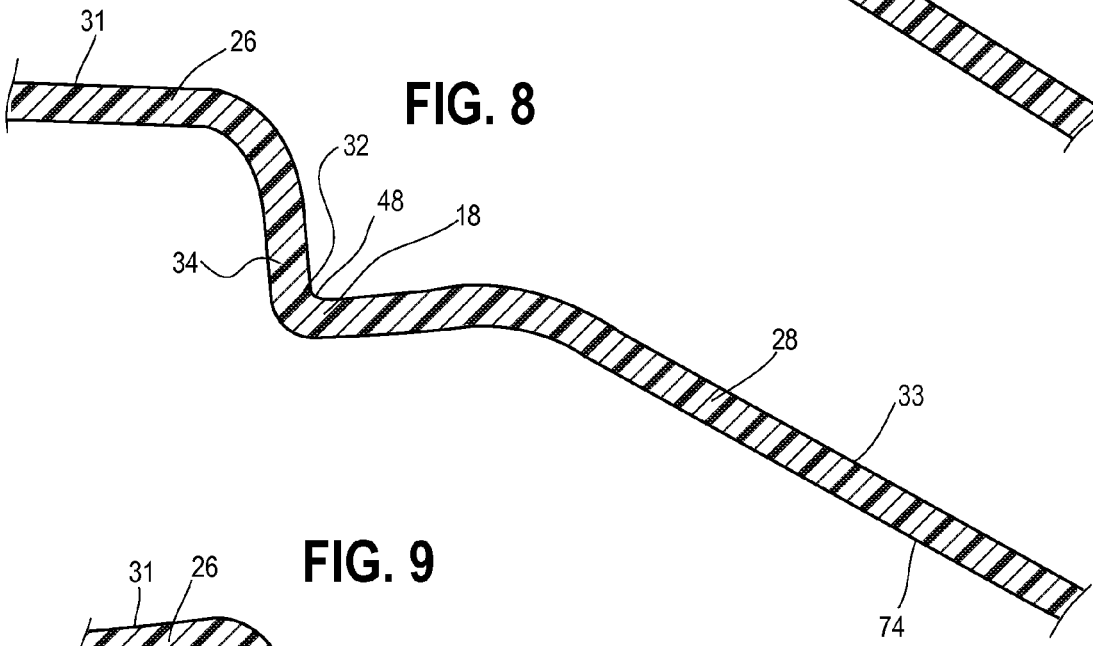
FIG. 8 is an enlarged cross-sectional view of the side elevational view of an intermediate portion of the container of FIG. 1 with a force being applied on the container.
Figure 9:
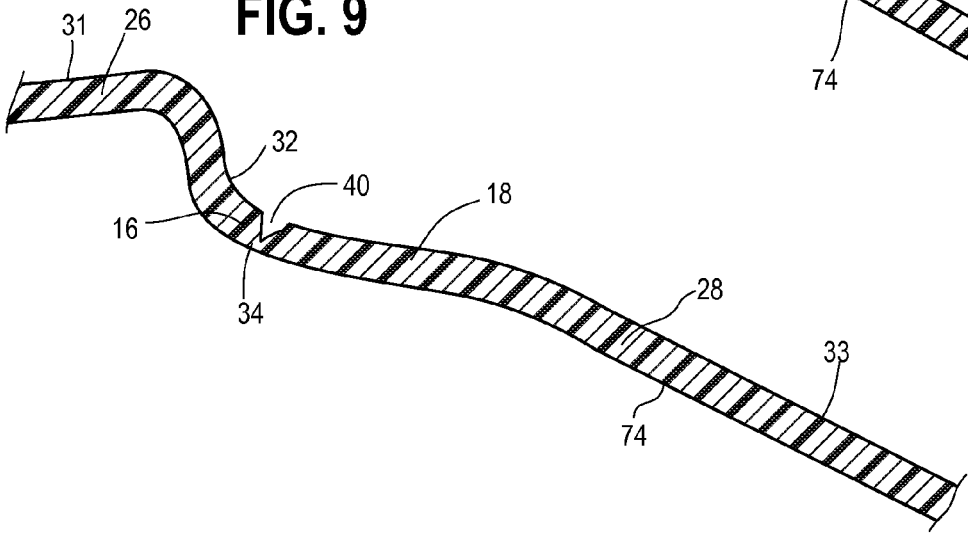
FIG. 9 is an enlarged cross-sectional view of the side elevational view of an intermediate portion of the container of FIG. 1 showing a fractured lower surface as a result of a force being applied on the container.

The bend 34 of the body 4 provides additional stress on the base surface 32 of the bend 34 along the outer surface 33 of the body 4 as force is applied to the engageable surface 30 of the distal portion 28. As shown in FIGS. 7-9, the bend 34 straightens as force is applied to the engageable surface 30. In particular, FIG. 7 shows a cross section of the body 4 with no force being applied. As shown in FIG. 8, as force is being applied to the engageable surface 30, the base surface 32 of the bend 34 is put under tension creating stress on the body 4. As shown in FIG. 9, once the stress along the base surface 32 exceeds the tension required to straighten the bend 34, the bend 34 straightens and a fracture 40 forms along the base surface 32 of the bend 34. Once fractured, the bend 34 defines the break path 16 along which a cleavage tear is propagated. The force required to initiate the fracture is greater than that required to propagate the tear along the break path 16. As a result, the container 2 is able to withstand higher stress and maintain a sealed condition, but allows for easy opening once the container 2 has been fractured.

The bend 34 includes an angle $\propto$ defined by wall portions 42 and 44 of the body 4 located on either side of the bend 34. The angle $\propto$ is configured to promote fracturing along the bend 34. In particular, a larger angle $\propto$ provides increased stress along the bend 34 as the bend 34 is straightened. To provide the desired increased stress, the angle $\propto$ is at least about 70 degrees. In some cases, the angle $\propto$ ranges from about 70 to about 90 degrees.

As indicated above, the body 4 includes other features to increase the amount of stress on the base surface 32 of the bend 34. The stress at the base surface 32 of the bend 34 can be characterized by the Bernoulli-Euler beam stress equation:

$$\sigma = \frac{My}{I_x}$$

σ—Average stress on the beam component.

M—The moment about a neutral axis 58 provided by the force applied at surface 30.

y—The perpendicular distance from the neutral axis 58 to the failure point, represented by the base surface 32 of the bend 34 in an unfractured container 2.

$I_x$—The second moment of area about the neutral axis 58.

The body 4 includes features to both increase the distance y between the neutral axis 58 and the base surface 32 of the bend 34 and decrease the second moment of area ($I_x$), specifically at the desired rupture or break path 16. The tapered profile 36 of the body 4 about the break path 16 reduces the amount of material located away from the neutral axis 58. Further, the height of the body 4 is reduced at the break path 16 to specifically reduce the second moment of area ($I_x$).

Figure 4:
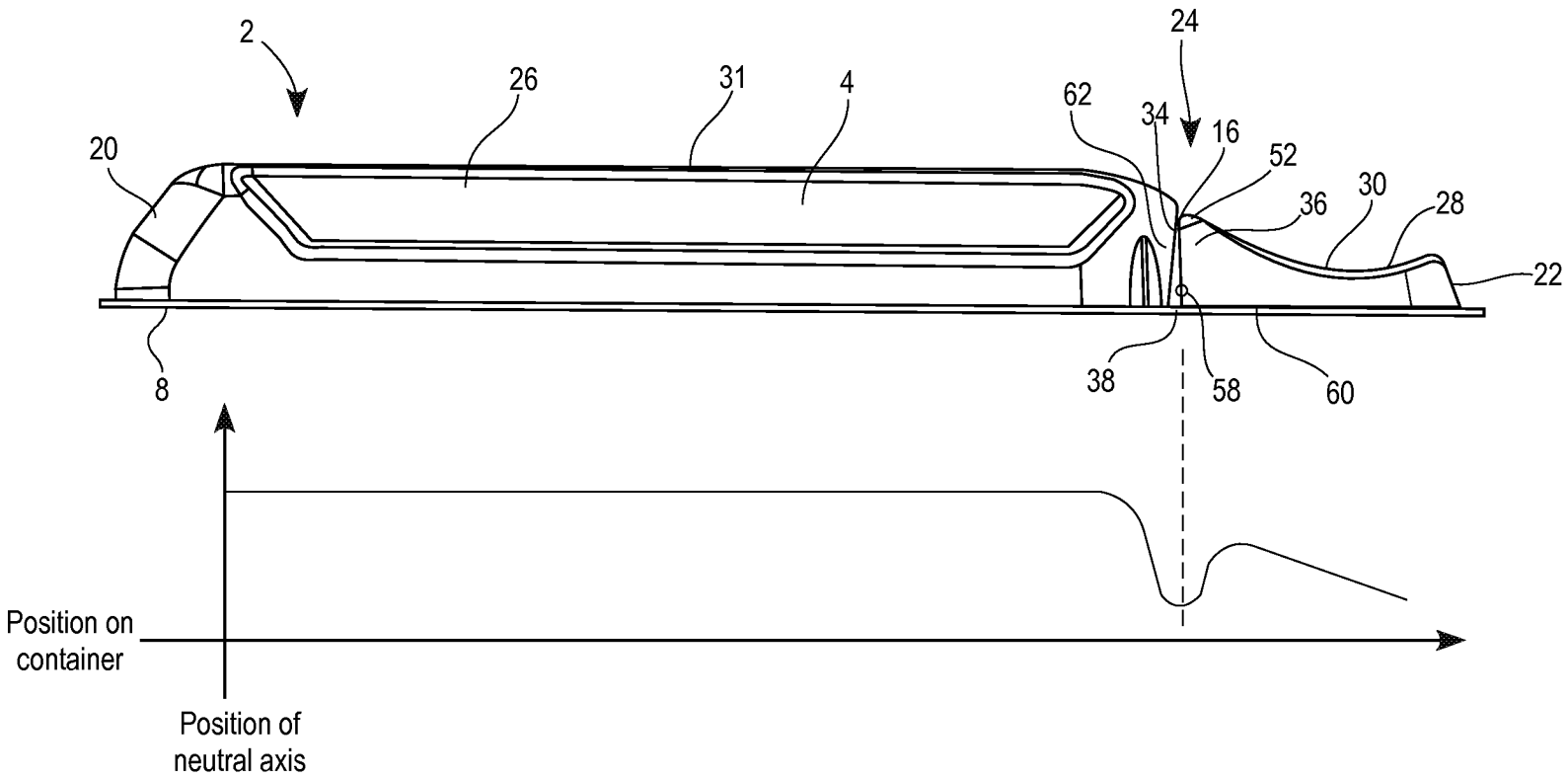
FIG. 4 is a side elevational view of the container of FIG. 1 and a graph showing the relative position of a neutral axis of the container along its length.
Figure 5:
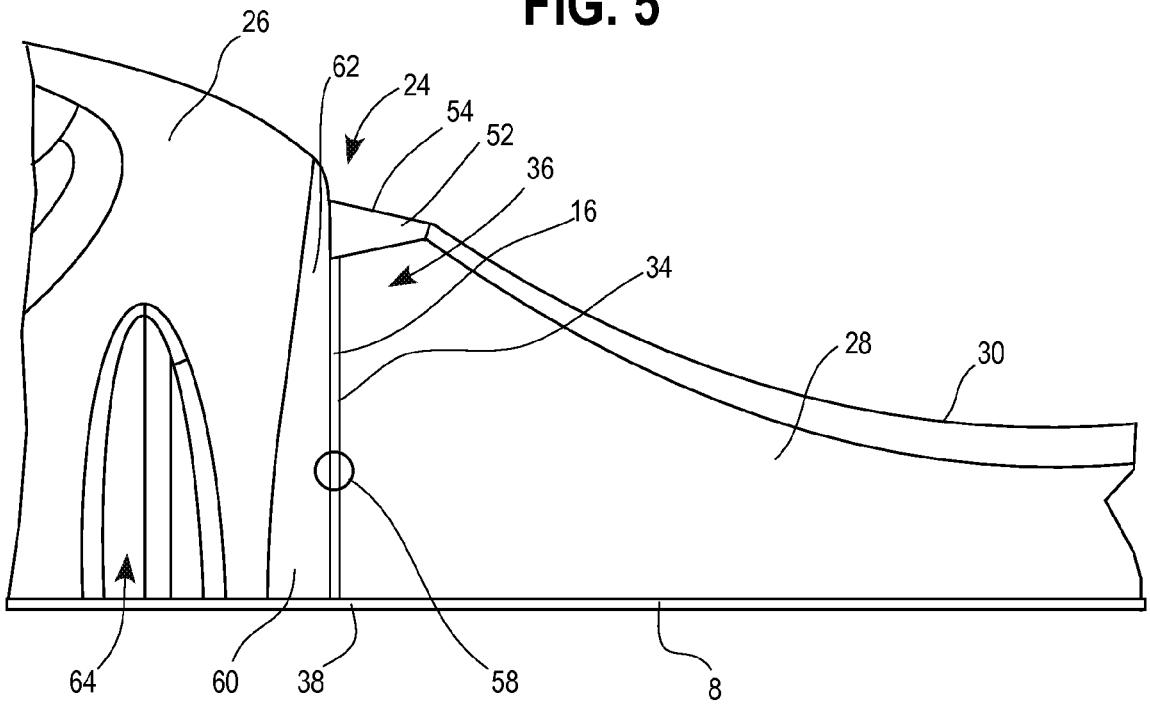
FIG. 5 is an enlarged side elevational view of the intermediate portion of the container of FIG. 1.
Figure 6:
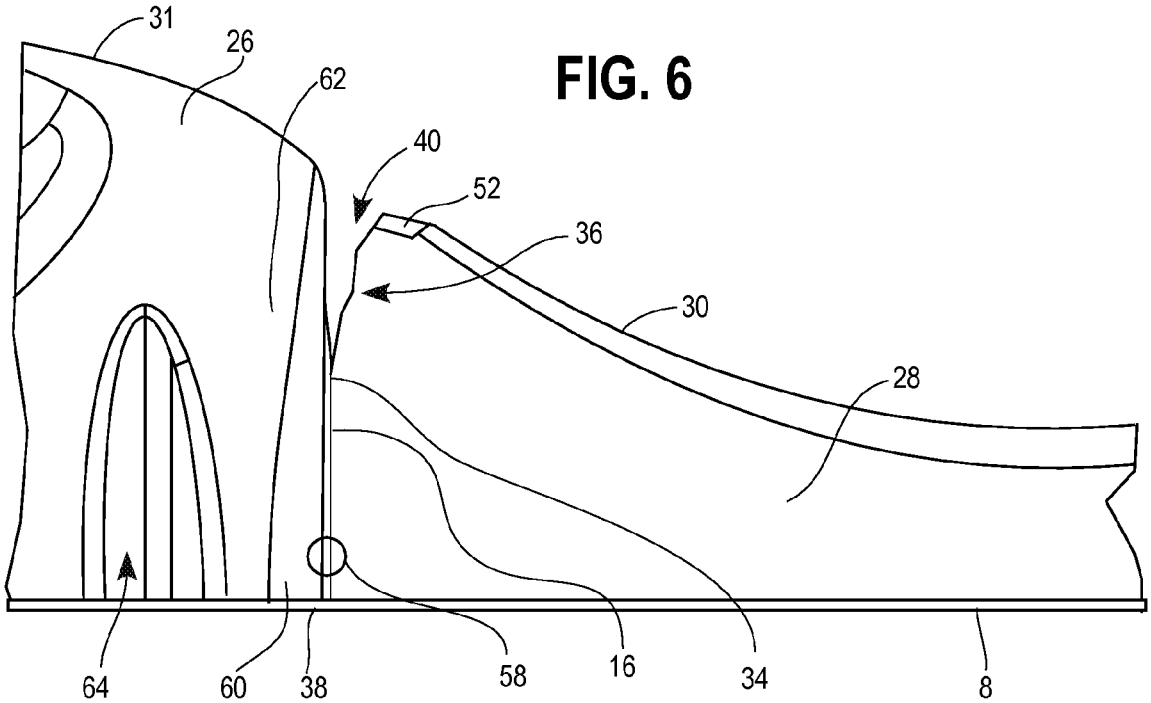
FIG. 6 is an enlarged side elevational view of the intermediate portion of the container of FIG. 1 showing a partially fractured body.

As shown in FIGS. 4-6, the container 2 includes a neutral axis 58 along which point there is no longitudinal stress. More particularly, upon the application of force on the engageable surface 30, compressive stress acts on a portion 60 of the container 2 extending from the neutral axis 58 to the flange 8. Further, tensile stress acts on a portion 62 of the container 2 extending from the neutral axis 58 to the base surface 32. The location of the neutral axis 58 is determined based upon the shape of the container 2 and the distribution of mass. As shown in FIG. 4, the location of the neutral axis 58 varies along the length of the container 2 as the shape or geometry of the body 4 changes. As described above, the Bernoulli-Euler equation represents that the stress at any given point of the container 2, as force is being applied to the engageable surface 30, is proportional to the distance y of that point from the neutral axis 58.

To guide the fracturing of the body 4 along the break path 16, the flange 8 of container 2 includes enlarged flange portions 38 along the intermediate portion 24 adjoining the break path 16. The enlarged flange portions 38 increase the mass of the flange 8 adjoining the break path 16 relative to the body 4. The increase of mass along the flange 8 shifts the neutral axis 58 within the intermediate portion 24 of the container 2 toward the flange 8 and away from the base surface 32 of the bend 34, as shown in FIG. 4. As a result, the base surface 32 is further away from the neutral axis 58, thereby proportionally increasing the stress at the base surface 32 along the break path 16 and reducing the amount of force necessary to overcome the tensile strength of the body 4.

As the base surface 32 fractures and the body 4 breaks, the neutral axis 58 shifts toward the flange 8 until the break reaches the flange 8. In particular, the neutral axis 58 shifts toward the enlarged flange portions 38 due to the increased mass associated with the enlarged flange portions 38. The movement of the neutral axis 58 guides the tearing along the break path 16.

As shown in FIGS. 1, 2, 10B, 11B, 12B and 13B, the upper edge 6 of the body 4 includes inwardly extending portions 63 at the ends of the break path 16. The inwardly extending portions 63 correspond to the enlarged portions 38 of the flange 8, thereby providing a reduced width of the body 4 extending between the enlarged flange portions 38.

Alternatively, other configurations providing the enlarged flange portion 38 are contemplated, including altering the thickness of the flange 8 adjacent the break path 16 or extending the flange 8 further outward. Further, it is contemplated that the flange 8 could extend inwardly or a combination of inwardly or outwardly from the upper edge 6 of the body 4.

To further concentrate the stress along the break path 16, the body 4 includes the tapered profile 36, as shown in FIGS. 1, 2 and 17-19. The tapered profile 36 provides a reduced width 46 of the base surface 32, which concentrates the stress produced by the application of force on the engageable surface 30 in a smaller area. As a result, the amount of force necessary to generate sufficient stress to straighten the bend 34 of the body 4 is reduced as compared to a container having a wider body.

Figure 17:
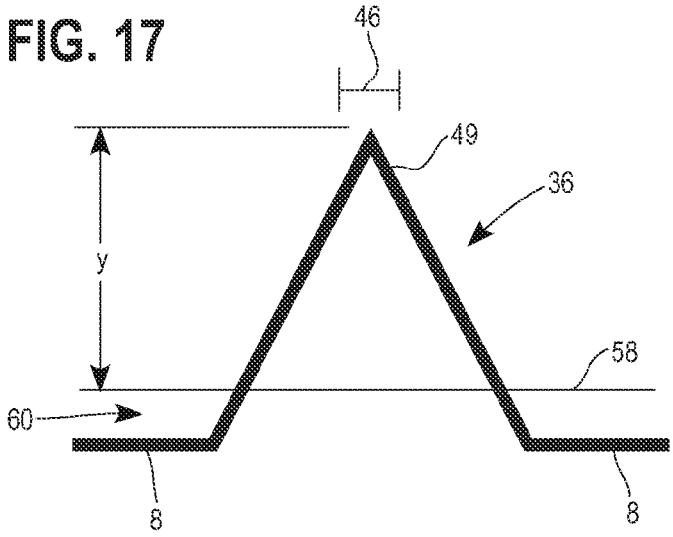
FIG. 17 is an end elevational, cross-sectional view of the container of FIG. 1 along the bend showing an angular tapered profile and the neutral axis, the cross-section being generally taken across line 17-17 in FIG. 16B.
Figure 18:
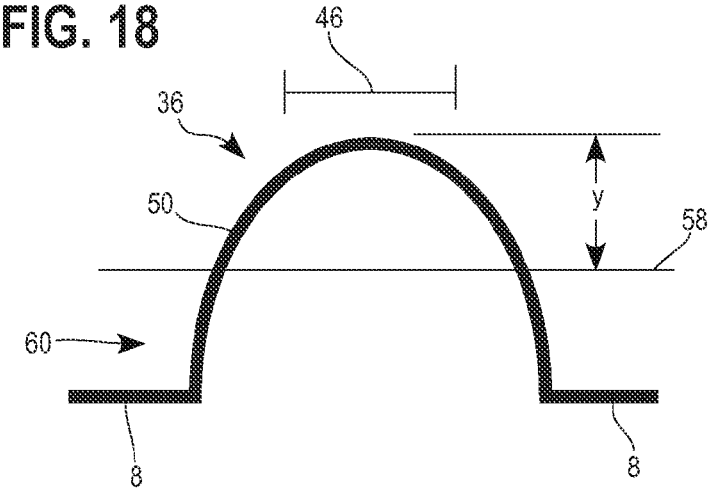
FIG. 18 is an end elevational, cross-sectional view of the container of FIG. 1 along the bend showing an alternative rounded tapered profile and the neutral axis, the cross-section being generally taken across line 17-17 in FIG. 16B.

The tapered profile 36 includes a peak 48 of the base surface 32 along the break path 16. The peak 48 can include an angular configuration 49, as shown in FIG. 17, to minimize the width 46 and thereby concentrate the stress on an even smaller area. Alternatively, as shown in FIG. 18, the peak 48 can include a rounded configuration 50. The rounded configuration 48 also provides the reduced width 46 which is slightly larger than the width of the angular configuration 49. Although this requires more force to fracture the body 4, the resulting opening is larger and can accommodate a quicker and easier dispensation of the contents of the cavity.

In addition to reducing the width 46 of the base surface 32 of the body 4, the tapered profile 36 also affects the position of the neutral axis 58 due to the reduced material utilized to provide a tapered profile 36 as compared to a more squared-off profile. As a result, the neutral axis 58 shifts toward the flange 8 and away from the base surface 32, thereby further increasing the stress along the base surface 32 as force is applied to the engageable surface 30.

Figure 19:
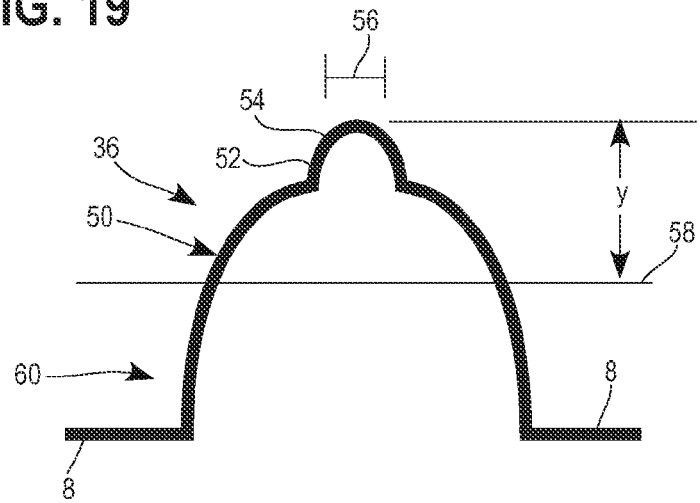
FIG. 19 is an end elevational, cross-sectional view of the container of FIG. 1 along the bend showing an alternative rounded tapered profile with a nipple and the neutral axis, the cross-section being generally taken across line 17-17 in FIG. 16B.

The peak 48 can further include a nipple 52 on the rounded configuration 48 of the body 4. As best shown in FIGS. 2 and 19, the nipple 52 extends from the rounded configuration 48 to provide an angular or almost angular base nipple surface 54. The base nipple surface 54 provides a nipple width 56 which would be less than the width 46 of the rounded configuration 48, but wider than an angular configuration 49. While the addition of the nipple 52 may shift the neutral axis 58 away from the flange 8, the distance y between the base surface 32 and the neutral axis 58 increases by a larger amount. The nipple 52 thereby causes stress to concentrate along a smaller area, similar to what would be observed with an angular configuration 49, but provides an increased opening size associated with the rounded configuration 50.

As shown in FIGS. 1 and 2, the container 2 includes inward protruding ribs 64 on the handle portion 26 of the body 4. The ribs 64 include a pair of spaced edges 66 and 68 opening to a recessed portion 70 of the body 4 and a corresponding widened section 72 of the flange 8. The ribs 64 provide relief from tensile stress along the body 4 as force is applied to the engageable surface 30. In particular, increased stress on the body 4 urges the spaced edges 66 and 68 away from one another, thereby flattening out the recessed portion 70 of the rib 64.

Figure 20:
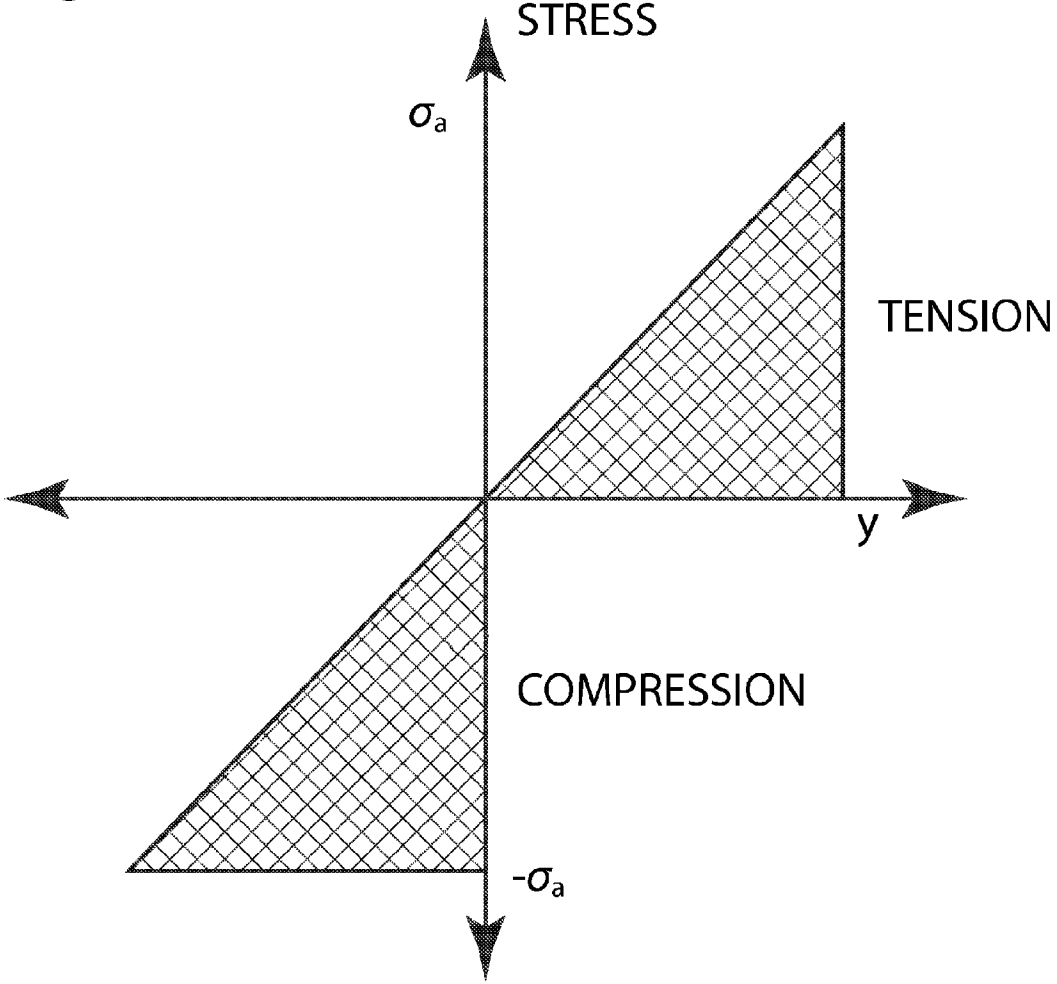
FIG. 20 is a graph comparing the linear relationship of stress and the distance y from the neutral axis.
Figure 21:
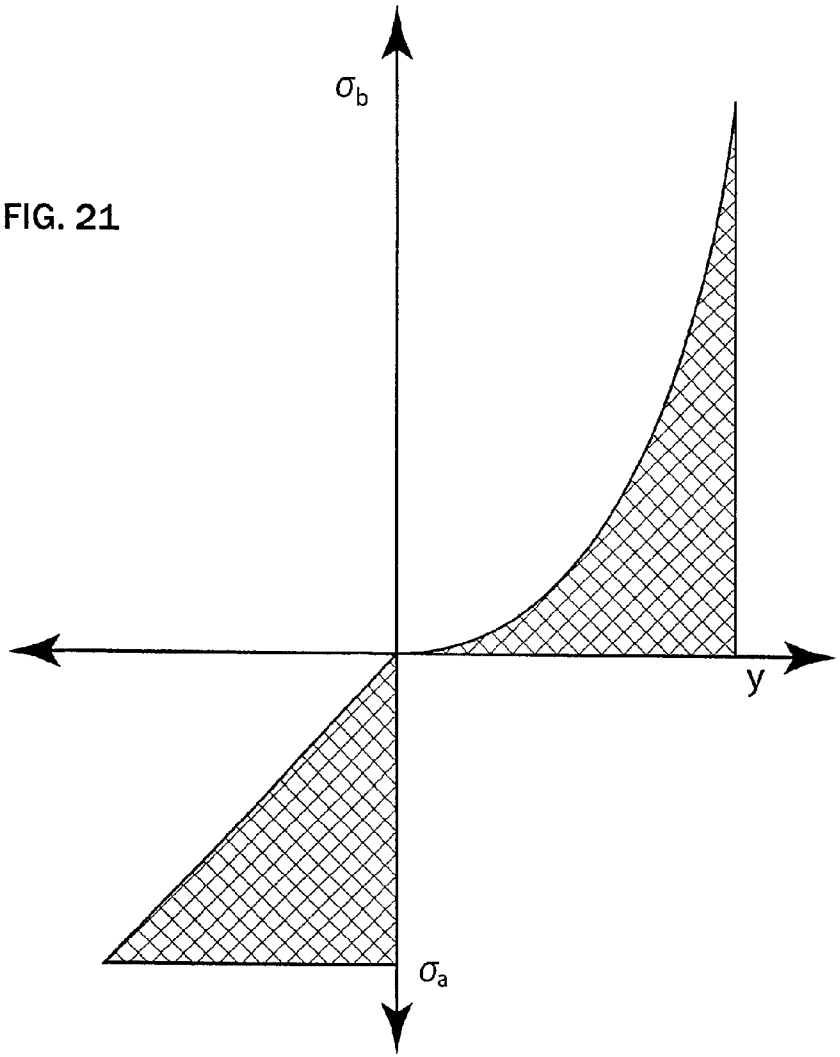
FIG. 21 is a graph comparing the relationship of stress and the distance y from the neutral axis with the container body including tension relieving ribs.

In the absence of the ribs 64, the stress at individual locations along the body 4 is generally directly proportional to the distance y from the neutral axis 58, as shown in FIG. 20. The average stress on the body 4 is the average of the stresses at the individual locations across the width of the body 4. However, the inclusion of ribs 64 acts to reduce the stress along the body 4 adjacent to the flange 8. As a result of the reduced stress along portions of the body 4, stress along other portions of the body 4 increases so that the average stress along the body 4 does not change. As shown in FIG. 21, the inclusion of ribs 64 causes stress to increase with distance y along a curve which more closely resembles an exponential curve than the linear relationship shown in FIG. 20. As a result, the stress on the body 4 adjacent the flange 8 is reduced, while the stress at the base surface 32 is increased significantly.

Figure 10B:
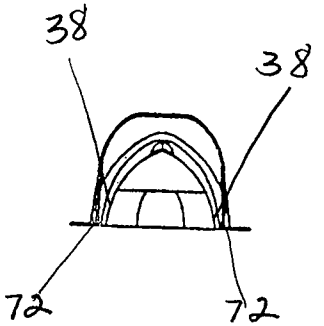
FIG. 10B is a cross-sectional view of an end elevational view of the container of FIG. 10A.
Figure 11B:
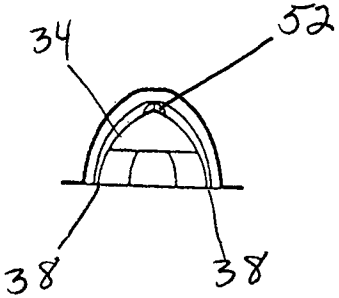
FIG. 11B is a cross-sectional view of an end elevational view of the container of FIG. 11A.
Figure 10A:
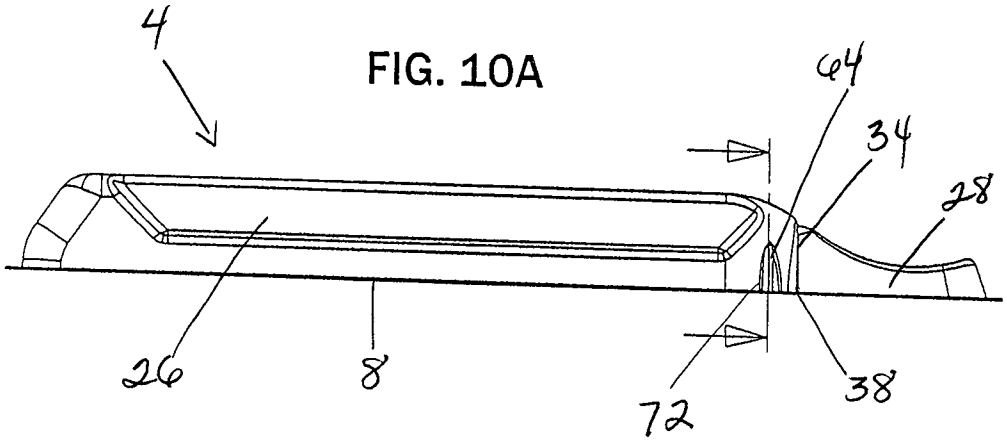
FIG. 10A is a side elevational view of the container of FIG. 1.
Figure 11A:
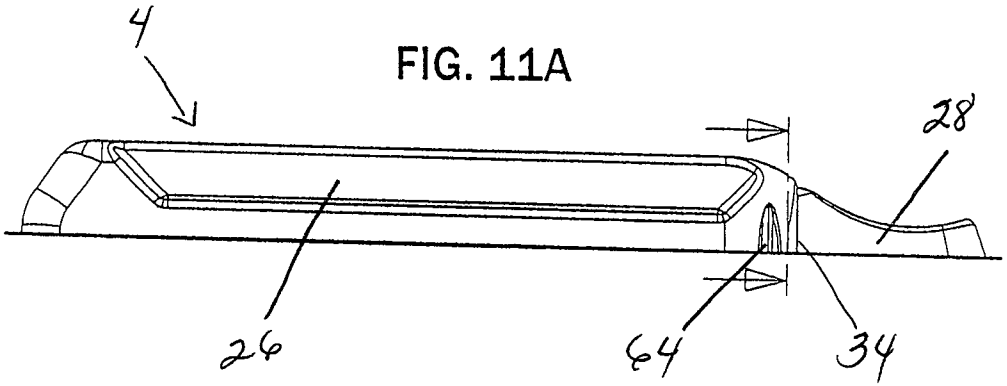
FIG. 11A is a side elevational view of the container of FIG. 1.
Figure 12B:
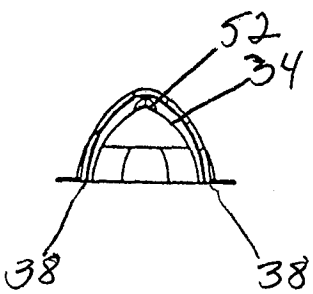
FIG. 12B is a cross-sectional view of an end elevational view of the container of FIG. 12A.
Figure 13B:
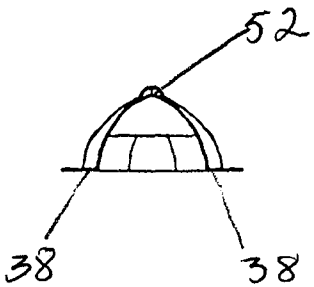
FIG. 13B is a cross-sectional view of an end elevational view of the container of FIG. 13A.
Figure 12A:
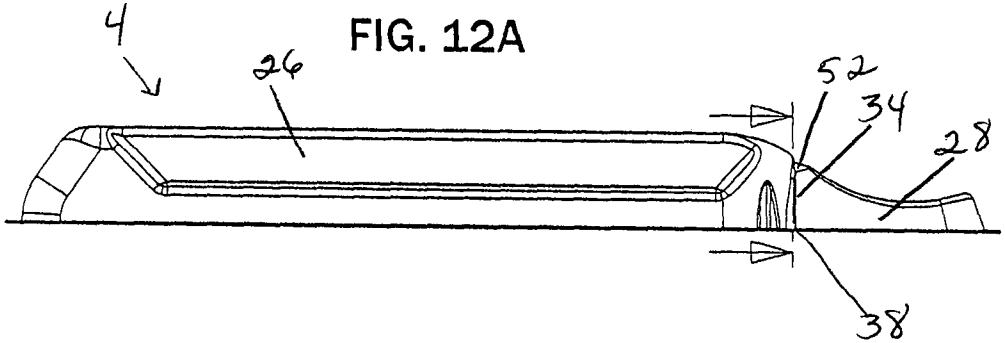
FIG. 12A is a side elevational view of the container of FIG. 1.
Figure 13A:
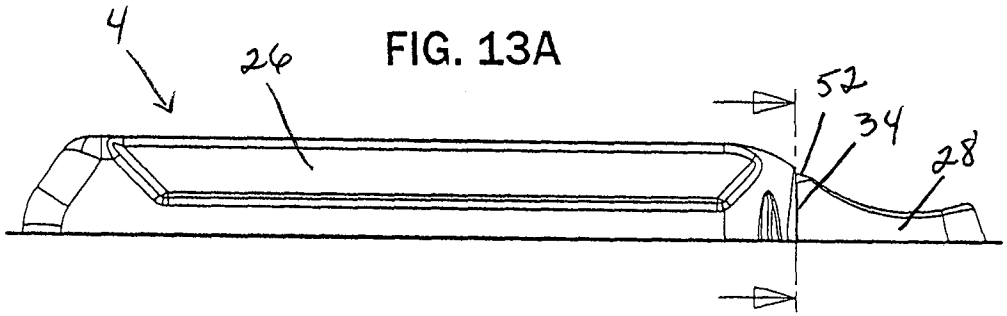
FIG. 13A is a side elevational view of the container of FIG. 1.
Figure 14B:
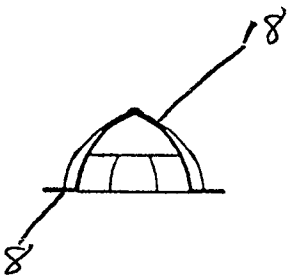
FIG. 14B is a cross-sectional view of an end elevational view of the container of FIG. 14A.
Figure 15B:
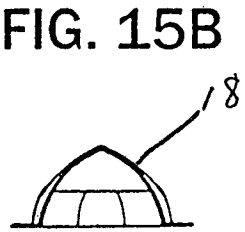
FIG. 15B is a cross-sectional view of an end elevational view of the container of FIG. 15A.
Figure 14A:
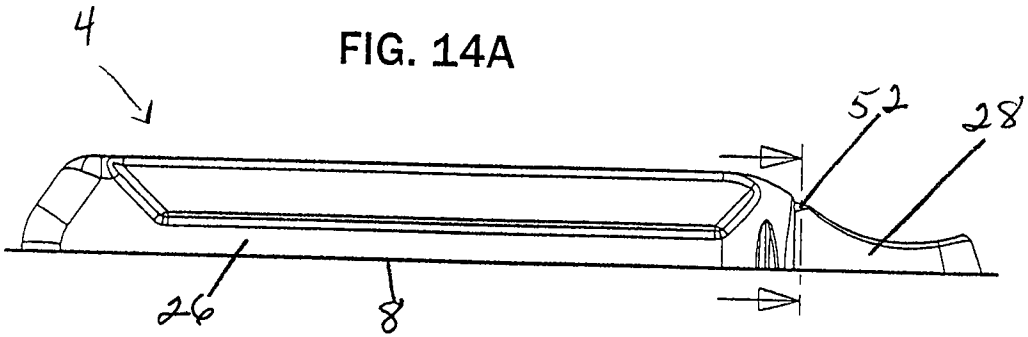
FIG. 14A is a side elevational view of the container of FIG. 1.
Figure 15A:
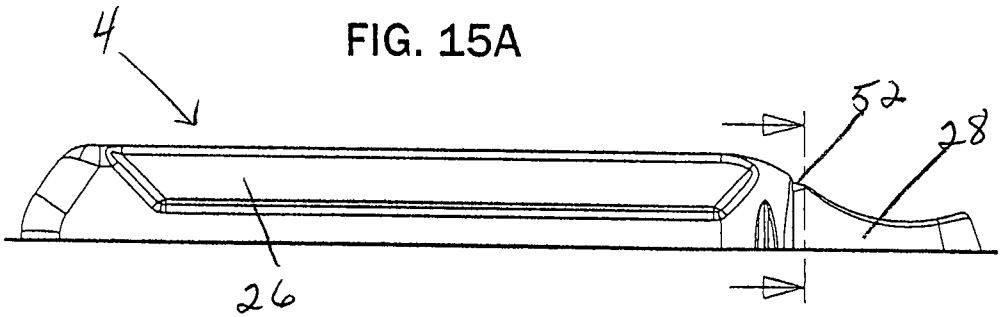
FIG. 15A is a side elevational view of the container of FIG. 1.
Figure 16A:
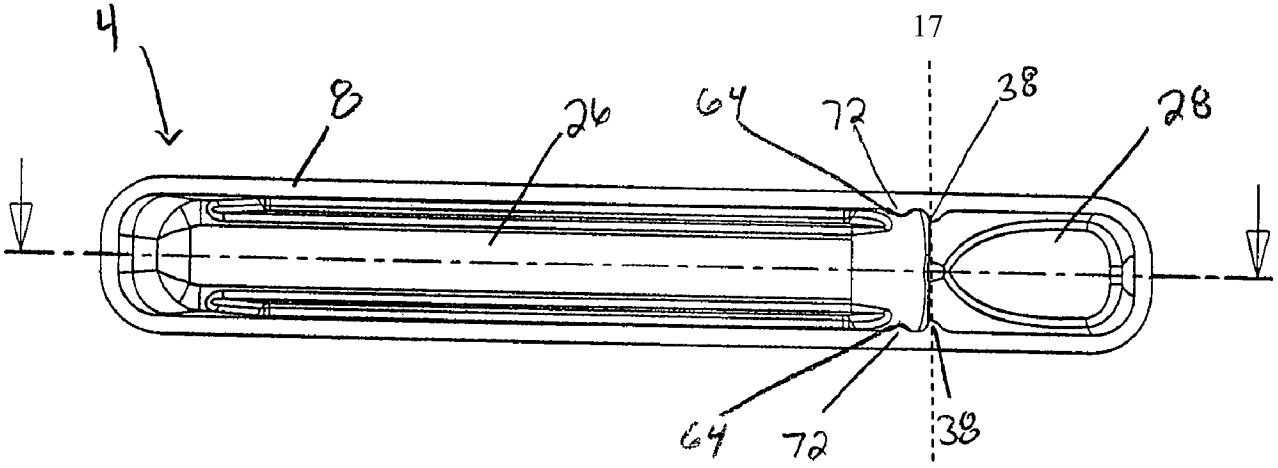
FIG. 16A is a plan view of the container of FIG. 1.
Figure 16B:
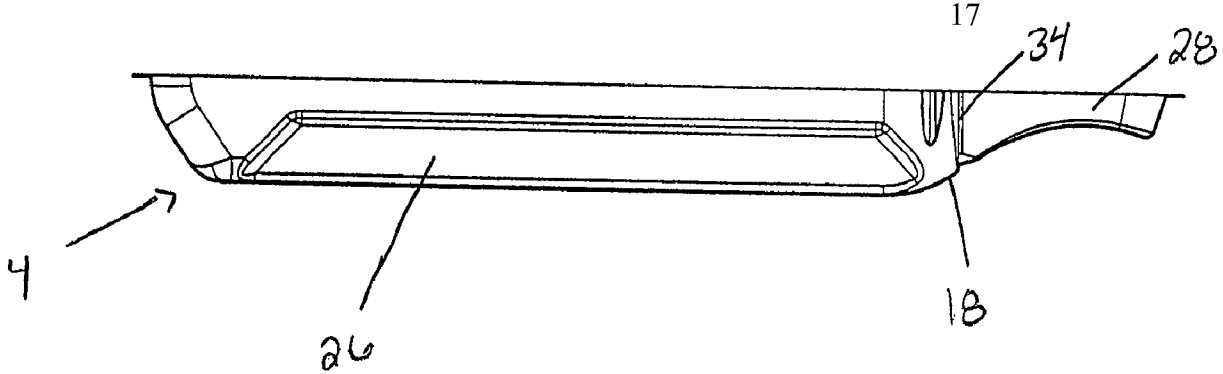
FIG. 16B is a side elevational, cross-sectional view of the container of FIG. 16A.

As shown in FIG. 10B, the recessed portions 70 of the ribs 64 are configured so that the widened sections 72 of the flange 8 adjoining the ribs 64 are not wider than the enlarged portion 38 of the flange 8 adjoining the break path 16. If the widened sections 72 were wider, the neutral axis 58 would be affected and the fracture would follow a ragged path toward the ribs 64 rather than a smooth, predefined path along the break path 16.

The ribs 64 further provide structural strength to the container 2 to resist collapse of the container 2.

The body 4 and flange 8 are preferably formed as a single member, as shown in FIGS. 1-4. The body 4 and flange 8 can be formed by known processes, in particular thermoforming. The body 4 and flange 8 are preferably constructed of a material which is strong enough to be handled, filled and transported. Further, the material must be brittle enough to allow for the body 4 to be fractured along the bend 34. Preferably, the material has low tear propagation strength so that after the initial fracture of the bend 34, the cleavage can continue without excessive force. In particular, exemplary materials include natural or low-impact polystyrene, medium impact polystyrene, and biaxially oriented polystyrene.

The body 4 has a wall thickness 18 selected to provide a robust container which can withstand the rigors of filling, distribution and handling. As indicated above, the wall thickness 18 remains generally constant about the break path 16. In some instances, the wall thickness 18 may range from about 0.3 mm to about 6 mm. In other instances, the wall thickness 18 may range from about 0.6 mm to about 1 mm. Further, in some cases it may be desirable to have a generally constant wall thickness along the entire body 4 to provide a constant level of protection along the container 2.

To accommodate specific materials being stored in the container 2, or to provide an additional level of protection, a functional inner coating or layer can be applied to an inner surface 74 of the body 4. The inner coating provides additional safeguards, such as acting as a sealant or an oxygen barrier. The addition of coatings to the inner surface 74 of the body 4 does not affect the fracturing processes as the fracturing occurs and is initiated on the outer surface 33 of the body 4. As such, the coating is applied in an amount to provide functional properties, not to provide structural support.

The outer cover 12 is made of a pliable material. The outer cover 12 may be affixed to the body 4 after the cavity is filled by a permanent adhesive seal, heat welding, or ultrasonic bonding. The outer cover material is selected to be able to act as a hinge between the handle portion 26 and the distal portion 28 once the bend 34 has been fractured. As such, the outer cover 12 is selected so as to not fracture or otherwise break as the body 4 is fractured. The outer cover 12 may be the same or different material than the body 4. For example, the cover 12 may be made from a single layer of polymer sheet, such as polypropylene, or from a laminate material containing, for example, a combination of polymer, paper or aluminum foil layers. The cover 12 can be printed to identify the product or the contents stored in the container 2.

The flange 8 can be configured to remain intact when the body is fractured and, with the cover 12, acts as a hinge between the handle portion 26 and the distal portion 28. In some cases, the body 4 is configured to be reclosable as disclosed in U.S. patent application Ser. No. 11/771,372 filed Jun. 29, 2007, which is hereby incorporated in its entirety herein.

Figure 22:
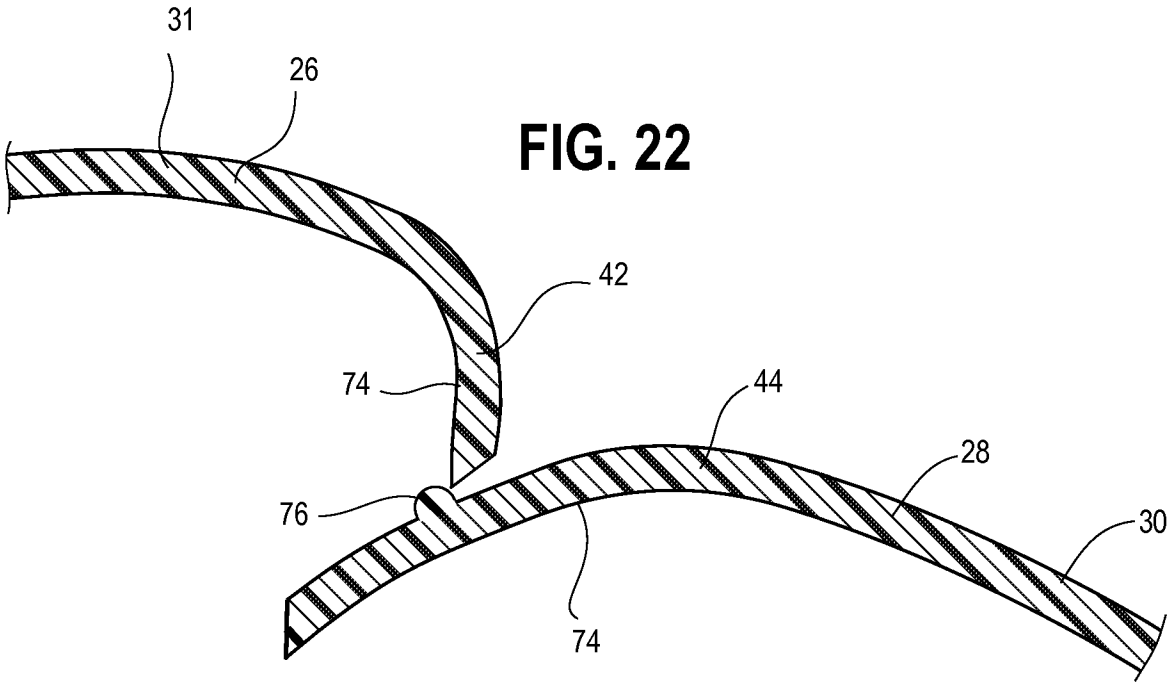
FIG. 22 is an enlarged cross-sectional view of the side elevational view of an intermediate portion of the container of FIG. 1 showing a fractured body reclosed by the frictional engagement of a protrusion of a wall portion frictionally engaged with another wall portion.

For example, the wall portions 42 and 44 can be configured to provide a friction fit therebetween after the body 4 has been fractured. In particular, as shown in FIG. 22, the wall portion 44 can include a protrusion 76 extending along the outer surface 30 thereof. The protrusion 76 can be configured to be received within the cavity and engage an inner surface 74 of the wall portion 42, thereby resisting pivoting of the distal portion 26 about the hinge.

While the invention has been particularly described with specific reference to particular method and product embodiments, it will be appreciated that various alterations, modifications, and adaptations may be based on the present disclosure, and are intended to be within the scope of the invention as defined by the following claims.

What is claimed is:

1. A container comprising:

a body having at least one cavity for storing dispensable contents;

an upper edge of the body defining an opening for filling the cavity;

a flange extending along the upper edge of the body;

a cover affixed to the flange to seal the dispensable contents within the cavity;

a bend of an intermediate portion of the body along which the body fractures upon the application of force exceeding a predetermined level on either side of the bend;

a tapered configuration of the intermediate portion of the body for providing a reduced width of the body so that stress concentrates along the reduced width as the force is applied on either side of the bend;

an enlarged portion of the flange at the bend;

the intermediate portion of the body is continuous and generally of constant thickness throughout; and enlarged width portions of the body on opposite sides of the intermediate portion.

2. The container of claim 1, wherein the bend includes a rounded configuration.

3. The container of claim 1, wherein the bend generally defines an angle of at least about 70 degrees.

4. The container of claim 1, wherein the bend generally defines an angle ranging from about 70 degrees to about 90 degrees.

5. The container of claim 1, wherein the body includes an indentation spaced from the bend to reduce stress on the body as force is applied on opposite sides of the bend.

6. The container of claim 1, wherein the flange extends outwardly from the upper edge of the body.

7. The container of claim 1, wherein the flange has a generally constant thickness throughout.

8. The container of claim 1, wherein the upper edge of the body includes a pair of inwardly extending portions corresponding to the enlarged portion of the flange.

9. The container of claim 1, wherein the tapered configuration includes an angular portion to reduce the width at the intermediate portion.

10. The container of claim 1, wherein the tapered configuration includes a rounded portion.

11. The container of claim 1, wherein the body comprises styrene.

12. The container of claim 1, wherein the body comprises a material selected from the group consisting of low-impact polystyrene, medium impact polystyrene and biaxially oriented polystyrene.

13. The container of claim 1 wherein the body has a generally constant thickness throughout the body.

14. A container, comprising:

a body having at least one cavity for storing dispensable contents;

an upper edge of the body defining an opening for filling the cavity;

a flange extending along the upper edge of the body;

a cover affixed to the flange to seal the dispensable contents within the cavity;

a bend of an intermediate portion of the body along which the body fractures upon the application of force exceeding a predetermined level on either side of the bend;

a tapered configuration of the intermediate portion of the body for providing a reduced width of the body so that stress concentrates along the reduced width as the force is applied on either side of the bend;

an enlarged portion of the flange at the bend;

the intermediate portion of the body is continuous and generally of constant thickness throughout;

wherein the tapered configuration includes a rounded portion; and wherein the tapered configuration includes a nipple having a width less than a reduced width of the rounded portion to concentrate stress along the nipple.

15. A container comprising:

a body having a cavity for storing dispensable contents;

an opening of the body for filling the cavity;

a flange extending about the opening of the body;

a wall of the body connected to and extending away from the flange, the wall defining at least a portion of the cavity;

a bend of an intermediate portion of the wall along which the body fractures upon an application of force exceeding a predetermined level on either side of the bend;

an enlarged portion of the flange at the bend; and an indentation in an outer portion of the wall adjacent the connection between the wall and the flange, the indentation being spaced from the bend to reduce stress on the body as force is applied on opposite sides of the bend.

16. The container of claim 15 wherein the flange includes a second enlarged portion adjacent the indentation in the wall.

17. The container of claim 16 wherein the second enlarged portion is smaller than the enlarged portion at the bend of the intermediate portion of the wall.

18. The container of claim 15 wherein the indentation extends along the wall generally perpendicular to the flange.

19. The container of claim 15 wherein the enlarged portion of the flange is configured to shift a neutral axis of the container toward the flange to provide increased stress along the bend as the force is applied on either side of the bend.

20. The container of claim 1 wherein the enlarged portion of the flange is configured to shift a neutral axis of the container toward the flange to provide increased stress along the bend as the force is applied on either side of the bend.

* * * * *